US011160391B2

(12) United States Patent
Schaffer et al.

(10) Patent No.: US 11,160,391 B2
(45) Date of Patent: Nov. 2, 2021

(54) APPARATUS AND METHOD FOR A CHILD CONTAINMENT SYSTEM

(71) Applicant: BABY JOGGER LLC, Atlanta, GA (US)

(72) Inventors: Alexis J. Schaffer, Philadelphia, PA (US); Annette C. Stella, Downingtown, PA (US); Corey Barnes, Grand Rapids, MI (US); Rachel Bennett, Brookhaven, GA (US); Nathan Christopher Causey, Woodstock, GA (US); Harlan Seth Dannenberg, San Francisco, CA (US); Ryan David Luecke, Marietta, GA (US)

(73) Assignee: BABY JOGGER LLC, Atlanta, GA (US)

( * ) Notice: Subject to any disclaimer, the term of this patent is extended or adjusted under 35 U.S.C. 154(b) by 153 days.

(21) Appl. No.: 16/414,221

(22) Filed: May 16, 2019

(65) Prior Publication Data

US 2019/0350378 A1 Nov. 21, 2019

Related U.S. Application Data

(60) Provisional application No. 62/672,241, filed on May 16, 2018.

(51) Int. Cl.
*A47D 11/00* (2006.01)
*A47D 13/06* (2006.01)

(52) U.S. Cl.
CPC ..... *A47D 11/007* (2013.01); *A47D 13/063* (2013.01); *A47D 13/066* (2013.01)

(58) Field of Classification Search
CPC .... A47D 11/007; A47D 13/06; A47D 13/061; A47D 13/063; A47D 13/066
See application file for complete search history.

(56) References Cited

U.S. PATENT DOCUMENTS 6,223,366 B1 * 5/2001 Cheng ..... A47D 13/063 16/326
6,233,759 B1 5/2001 Warner, Jr. et al.
(Continued)

OTHER PUBLICATIONS

Chicco 2017 Lullago Zip Light Grey by Chicco https://www.amazon.com/Chicco-2017-Lullago-Light-Grey/dp/B01JS9F378.
(Continued)

*Primary Examiner* — David R Hare
(74) *Attorney, Agent, or Firm* — Eversheds Sutherland (US) LLP

(57) ABSTRACT

A child containment system or playard can include a frame and soft goods panels. The frame can include a top frame assembly and one or more legs extending down therefrom in a use configuration. The legs can be pivotable with respect to the top frame assembly to a stored configuration, where the legs are substantially parallel with portions of the top frame assembly. The playard can also include top rail soft goods attached to at least a portion of the top frame assembly. A first portion of the bassinet base can be stored in a cavity of a first portion of the top rail soft goods and a second portion of the bassinet base can be stored in another cavity of a second portion of the soft goods. The first and second base portions can be coupled together when needed and stored in the cavities when not in use.

19 Claims, 12 Drawing Sheets

(56) References Cited

U.S. PATENT DOCUMENTS

| | | | | |
|---|---|---|---|---|
| 6,434,767 | B1 * | 8/2002 | Welsh, Jr. | A47D 7/04 5/93.2 |
| 7,739,759 | B2 * | 6/2010 | Mendes | A47D 9/005 5/93.1 |
| 7,770,245 | B2 | 8/2010 | Cheng et al. | |
| 9,009,887 | B2 | 4/2015 | Lo | |
| 9,149,128 | B2 * | 10/2015 | Rampton | A47D 13/063 |
| 9,801,473 | B2 * | 10/2017 | Jackson | A47D 13/06 |
| D804,217 | S | 12/2017 | Festa | |
| 9,901,187 | B2 * | 2/2018 | Burkholder | A47D 9/005 |
| 10,064,499 | B2 * | 9/2018 | Szymanski | A47D 9/005 |
| 2006/0021134 | A1 * | 2/2006 | Chen | A47D 13/06 5/93.1 |
| 2010/0138991 | A1 * | 6/2010 | Hartenstine | A47D 7/04 5/99.1 |
| 2012/0233770 | A1 * | 9/2012 | Greger | A47D 9/00 5/98.1 |
| 2013/0117930 | A1 * | 5/2013 | Hsu | A47D 9/005 5/93.1 |
| 2016/0286979 | A1 | 10/2016 | Sclare | |
| 2018/0146796 | A1 * | 5/2018 | Longenecker | A47D 13/063 |

OTHER PUBLICATIONS

Guzzie & Guss Habitat Playard & Bassinet Black https://well.ca/products/guzzie-guss-habitat-playard_117201.html.

* cited by examiner

APPARATUS AND METHOD FOR A CHILD CONTAINMENT SYSTEM

RELATED APPLICATIONS

This application claims priority under 35 U.S.C. § 119 to U.S. Provisional Patent Application No. 62/672,241 filed May 16, 2018, and titled "APPARATUS AND METHOD FOR A CHILD CONTAINMENT SYSTEM WITH INTEGRATED BASSINET," the entire contents of which are hereby incorporated herein by reference for all purposes.

TECHNICAL FIELD

Embodiments disclosed herein are generally related to child containment systems, such as a portable playard, and more particularly to apparatuses and methods for a playard that includes a raised bassinet area that is integral with the playard and/or a spring-assisted leg folding mechanisms.

BACKGROUND

Conventional playards (also frequently referred to as a pack 'n play) typically provide a raised play area that is enclosed on five sides, four surrounding wall panels and a bottom panel, that are coupled together to form an enclosed recessed play area. The conventional playards provide a convenient and safe device for letting infants and small children play and sleep.

Certain conventional playards may also include a removable bassinet. The bassinet provides a shallower recessed area into which a smaller child or infant (typically one that is not yet able to roll over or push up on their hands and knees) can be placed. The bassinet can include a sleeping surface, and/or pad that the child can be placed upon. The bassinet can also include walls or side portions that extend above the sleeping surface to help contain the child in the bassinet. Bassinets designed to be removably coupled to a playard typically have a width that is less than the width of the top opening of the playard and a length that is less than the length of the top opening of the playard.

One drawback of bassinets that are designed to be removably coupled to the playard is that when they are not in use, the user must find a place to store the bassinet, away from the playard. The storage of the bassinet can take up space that can be used for other things. In addition, once the bassinet is removed from the playard, it can be lost or damaged and may no longer be useful. Similarly, when a caregiver is traveling with a child, having a bassinet that is designed to be removably coupled to the playard can also be difficult. It could be difficult to find a place to store the bassinet when not in use and there is an increased chance that pieces that are removed from the playard may be lost during travel.

BRIEF DESCRIPTION OF THE SEVERAL VIEWS OF THE DRAWINGS

For a more complete understanding of the present disclosure and certain features thereof, reference is now made to the following description, in conjunction with the accompanying figures briefly described as follows.

DETAILED DESCRIPTION OF THE EXAMPLE EMBODIMENTS

Example embodiments now will be described more fully hereinafter with reference to the accompanying drawings, in which example embodiments are shown. The concepts claimed and described herein may, however, be embodied in many different forms and should not be construed as limited to the example embodiments set forth herein; rather, these embodiments are provided so that this disclosure will be thorough and complete, and will fully convey the scope of the claimed invention to those skilled in the art. Like numbers refer to like, but not necessarily the same, elements throughout.

Certain dimensions and features of the example playard are described herein using the term "approximately." As used herein, the term "approximately" indicates that each of the described dimensions is not a strict boundary or parameter and does not exclude functionally similar variations therefrom. Unless context or the description indicates otherwise, the use of the term "approximately" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

In addition, certain relationships are described herein using the term "substantially." As used herein, the terms "substantially" and "substantially equal" indicates that the relationship or equal relationship is not a strict relationship and does not exclude functionally similar variations therefrom. Unless context or the description indicates otherwise, the use of the term "substantially" or "substantially equal" in connection with two or more described dimensions or elements indicates that the equal relationship between the dimensions or elements includes variations that, using mathematical and industrial principles accepted in the art (e.g., rounding, measurement or other systematic errors, manufacturing tolerances, etc.), would not vary the least significant digit of the dimensions or elements. As used herein, the term "substantially constant" indicates that the constant relationship is not a strict relationship and does not exclude functionally similar variations therefrom. As used herein, the term "substantially parallel" indicates that the parallel relationship is not a strict relationship and does not exclude functionally similar variations therefrom.

Figure 1A:
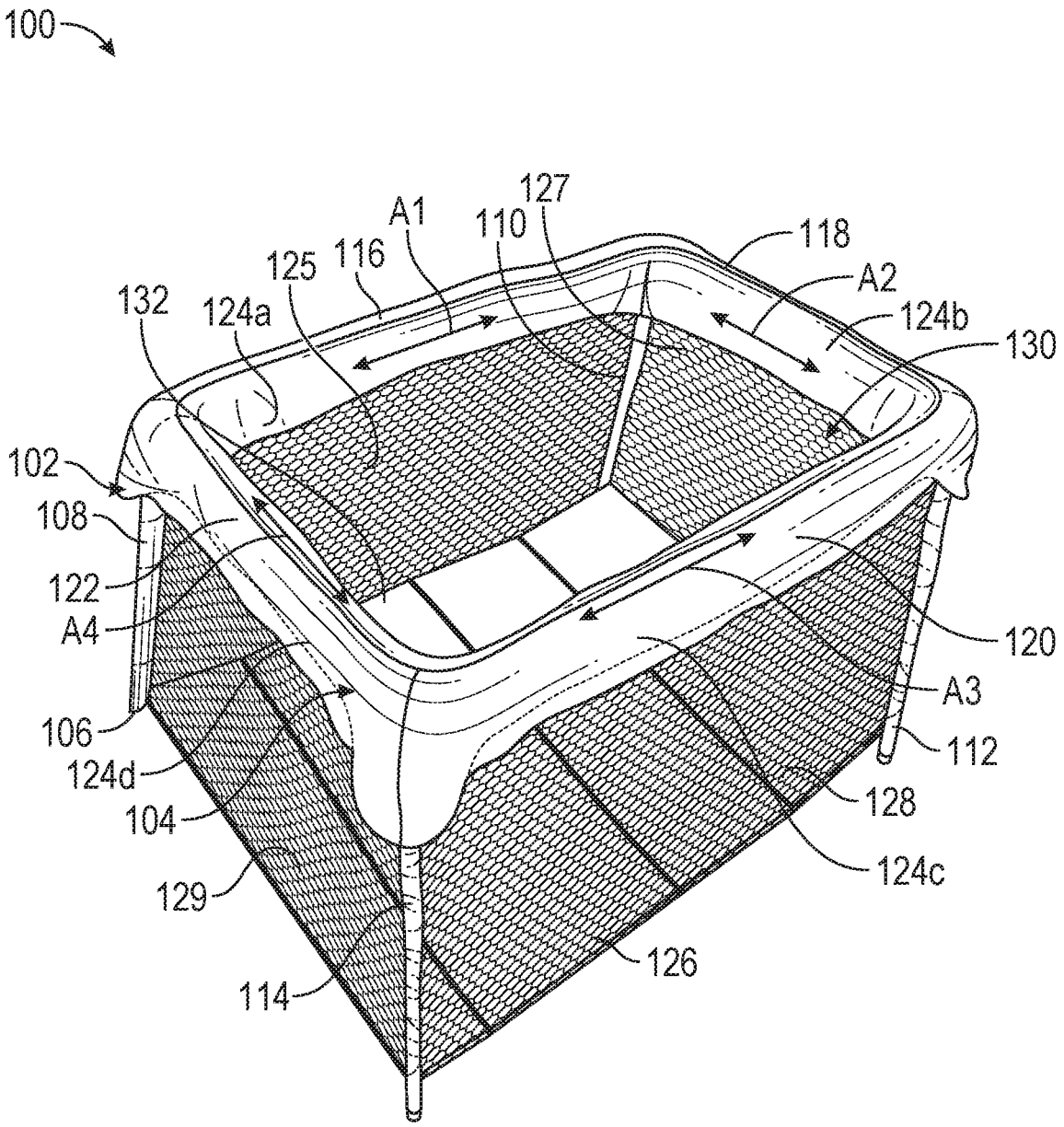
FIG. 1A presents a perspective view of a child containment system showing a bassinet in a stored configuration, in accordance with one example embodiment of the disclosure.

FIGS. 1A-1I present a variety of perspective and side elevation views of a child containment system 100 and the adjustment of the integrated bassinet from a stored configuration to a use configuration, in accordance with one example embodiment of the disclosure. Referring to FIG. 1A, the child containment system 100, referred to hereinafter as both an "child containment system" and "playard" for example, can include a frame assembly 102 that supports and defines a play surface suspended above a floor or other ground surface. In one example, the frame assembly 102 can be substantially the same as the frame assembly 202 of FIGS. 2A-3B. In other examples, the frame assembly 102 can be different from the frame assembly 202 of FIGS. 2A-3B, and may not include the spring-assisted folding leg mechanisms described with reference to FIG. 2B.

As shown in FIG. 1A, the example frame assembly 102 defines a play surface that has rectangular or substantially rectangular base or bottom panel 128, a pair of opposed side walls or panels 125 and 126 and a pair of opposed end walls or panels 127 and 129. While the example frame assembly 102 is shown and described as having a rectangular shape, this is for example purposes only, as the bottom panel 128 can have any shape, including but not limited to square, circular, oval, triangular, hexagonal, etc. and the frame assembly 102 can have any number of walls/panels, including a single wall/panel. The walls/panels 125, 126, 127, 129 can extend upward from the generally flat or horizontal base panel 128 to surround the play surface and define a first child containment area 130 for an infant or toddler. The end 127, 129; side 125, 126; and base 128 walls/panels can be generally formed of soft goods, such as any combination of fabric material, plastic material, see-through mesh material, or any other material known to those of ordinary skill in the art. The end 127, 129; side 125, 126; and base 128 walls/panels can be suspended from or otherwise supported by the frame assembly 102 as shown. In one example, at least a portion of the frame assembly 102 can be covered by fabric or another form of soft goods and can thus be largely concealed from view, as shown in FIG. 1A. In addition, a mattress pad 132 or other cushion can be positioned along the top surface of the base or bottom panel 128 and cover substantially all of the top side surface area of the base or bottom panel 128 and can be configured to receive a child thereon.

The integrated bassinet in the playard disclosed herein can be used with virtually any type of playard having virtually any type of frame assembly 102. The frame assembly 102 shown in FIG. 1A and described below is provided just as an example type of frame assembly. Those of ordinary skill in the art will recognize that many changes and modifications to the frame assembly 102, including but not limited to the frame assembly 202 of FIGS. 2A-3B, can be made from that shown and described below while still incorporating the concepts of the integrated bassinet.

In one example, as shown in FIG. 1A, the frame assembly 102 can include a top rail assembly 104, a bottom rail assembly 106 and a number of support members 108, 110, 112, 114 coupling the top rail assembly 104 to the bottom rail assembly 106. In one example, each of the support members 108, 110, 112, and 114 can extend vertically or substantially vertically from the top rail assembly 104 to the bottom rail assembly 104 when the frame assembly 102 is in the use configuration. In another example embodiment, the frame assembly 102 may not include the bottom rail assembly 106 and each of the support members 108, 110, 112, and 114 can extend vertically or substantially vertically from the top rail assembly 104 towards the ground or other floor surface when the frame assembly 102 is in the use configuration. In other examples, the support members 108, 110, 112, and 114 may be at any angle less than 30 degrees offset from a vertical position when the frame assembly 102 is in the use configuration. In certain examples, each support member 108, 110, 112, 114 may be referred to as a "leg" or "leg member". Each of the top rail assembly 104, bottom rail assembly 106 and support members 108, 110, 112, 114, can be made of metal, plastic, or a combination thereof. In certain examples, at least a portion of the top rail assembly 104, bottom rail assembly 106, and support members 108, 110, 112, 114 include elongated solid or hollow tubular rod members.

In one example, the top rail assembly 104 can include a first top end rail assembly 118 and a second top end rail assembly 122. The first top end rail assembly 118 and second top end rail assembly 122 can be positioned generally along a top portion of the corresponding end walls/panels 127 and 129 respectively. In certain example embodiments, each of the first top end rail assembly 118 and the second top end rail assembly 122 can be constructed of a single rail member, a pair of rail members, or more than two rail members. In example embodiments where the first top end rail assembly 118 and second top end rail assembly 122 include two or more rail members, the rail members may be pivotable with respect to one-another and optionally with respect to the adjacent support members 108, 110, 112, and 114 and the assembly may include rail locking mechanisms that are positioned between and coupled to the rail members at their respective ends to allow each rail member to pivot with respect to the rail locking mechanism. Each of the top end rail assemblies 118, 122 can be constructed of plastic, metal or a combination thereof and each of the top end rail members can be a solid, tubular, or substantially tubular member that includes a hollow channel extending from a first end to an opposing second end of the respective top end rail member.

The top frame assembly 104 can further include a first top side rail assembly 116 and an opposing second top side rail assembly 120. Each of the first top side rail assembly 116 and the second top side rail assembly 120 can be positioned generally along a top portion of the corresponding side walls/panels 125 and 126 respectively. In certain example embodiments, each of the first top side rail assembly 116 and the second top side rail assembly 120 can be constructed of a single rail member, a pair of rail members, or more than two rail members. In example embodiments where the first top side rail assembly 116 and second top side rail assembly 120 include two or more rail members, the rail members may be pivotable with respect to one-another and optionally with respect to the adjacent support members 108, 110, 112, and 114 and/or the adjacent top end rail assembly 118, 122 and the assembly 116, 120 may include rail locking mechanisms that are positioned between and coupled to the rail members at their respective ends to allow each rail member to pivot with respect to the rail locking mechanism. Each of the top side rail assemblies 116, 120 can be constructed of plastic, metal or a combination thereof and each of the top side rail members can be a solid, tubular, or substantially tubular member that includes a hollow channel extending from a first end to an opposing second end of the respective top side rail member. Each of the top side rail assemblies 116, 120 can have a first end and a distal second end and can extend generally in a horizontal or substantially horizontal manner from the first top end rail assembly 118 to the second top end rail assembly 122 when the frame assembly 102 is in the use configuration.

In one example, the first top end rail assembly 118 can have a first end pivotably coupled to a first corner assembly and a second distal end pivotably coupled to a second corner assembly. The first top end rail assembly 118 can be configured to pivot with respect first corner assembly about a first rotation axis at the pivotable coupling to the first corner assembly and configured to pivot with respect to the second corner assembly about a second rotation axis at the pivotable coupling to the second corner assembly.

In certain example embodiments, the second top side rail assembly 120 can have a first end fixedly coupled or pivotably coupled to the second corner assembly and a distal second end fixedly coupled or pivotably coupled to a third corner assembly. In an example where the second top side rail assembly pivots with respect to the second corner assembly and third corner assembly, the second top side rail assembly 120 can be configured to pivot with respect to the second corner assembly about a third rotation axis at the pivotable coupling to the second corner assembly and configured to pivot with respect to the third corner assembly about a fourth rotation axis at the pivotable coupling to the third corner assembly.

In certain example embodiments, the second top end rail assembly 122 can have a first end pivotably coupled to the third corner assembly, and a distal second end pivotably coupled to a fourth corner assembly. The second top end rail assembly 122 can be configured to pivot with respect to the third corner assembly about a fifth rotation axis at the pivotable coupling to the third corner assembly and configured to pivot with respect to the fourth corner assembly about a sixth rotation axis at the pivotable coupling to the fourth corner assembly.

In certain example embodiments, the first top side rail assembly 116 can have a first end fixedly coupled or pivotably coupled to the fourth corner assembly and a distal second end fixedly coupled or pivotably coupled to the first corner assembly. In examples where the first top side rail assembly 116 pivots or rotates with respect to the fourth corner assembly and the first corner assembly, the first top side rail assembly 116 can be configured to pivot with respect to the fourth corner assembly about a seventh rotation axis at the pivotable coupling to the fourth corner assembly and configured to pivot with respect to the first corner assembly about an eighth rotation axis at the pivotable coupling to the first corner assembly. Each of the corner assemblies can be constructed in any manner known to those of ordinary skill in the art, including, but not limited to, that shown and described with reference to FIGS. 2A-3B, such that the top end rail assemblies 118, 122 and/or the top side rail assemblies 116, 120 may be, if desired, pivotable with respect to the corresponding corner assembly.

In one example, the first, second, fifth, and sixth rotation axes are parallel or substantially parallel to one another and the third, fourth, seventh, and eighth rotation axes are parallel or substantially parallel to one another. In an alternative embodiment, each of the first top side rail assembly 116, first top end rail assembly, 118, second top side rail assembly 120, and second top end rail assembly 122 may be rigidly fixed to the respective corner assembly rather than pivotable with regard to the respective corner assembly. In yet another alternative embodiment, the second end of the first top side rail assembly 116 is coupled to the first end of the first top end rail assembly 118, the second end of the first top end rail assembly 118 is coupled to the first end of the second top side rail assembly 120, the second end of the second top side rail assembly 120 is coupled to the first end of the second top end rail assembly 122, and the second end of the second top end rail assembly 122 is coupled to the first end of the first top side rail assembly 116.

Each of the top side rail assemblies 116, 120 and top end rail assemblies 118, 122 are horizontally or substantially horizontally positioned when the playard 100 is in the use configuration, as shown in FIG. 1A. In one example, the top side rail assemblies 116, 120 and top end rail assemblies 118, 122, and optionally the first, second, third, and fourth corner assemblies collectively define a top end of the child containment area 130 for the playard 100. In certain example embodiments, each of the top side rail members of the top side rail assemblies 116, 120 and top end rail members of the top end rail assemblies 118, 122 can have a circular or substantially circular cross-sectional shape. In one example, the circular or substantially circular cross-sectional shape can increase the ease of slidably inserting and passing the top side rail members of the top side rail assemblies 116, 120 and/or top end rail members of the top end rail assemblies 118, 122 through one or more top end channels along a top end of the fabric or other top rail soft goods material 124*a*-124*d* (collectively referred to as "124") configured to extend along one of the sides of the playard 100. In other example embodiments, each of the top side rail members of the top side rail assemblies 116, 120 and top end rail members of the top end rail assemblies 118, 122 can have any other cross-sectional shape including, but not limited to, rectangular or oval.

Top rail soft goods 124, such as any combination of fabric material, plastic material, padding, see-through mesh material, or any other material known to those of ordinary skill in the art can be fixedly or removably coupled to the top frame assembly 104. For example, the top rail soft goods

124 can be stitched or otherwise affixed to itself such that the top rail soft goods overlap and are vertically supported by the top frame assembly 104. For example, the top rail soft goods 124, including padding, can include a first top rail soft goods section 124*a* that overlaps the first top side rail assembly 116 and first corner assembly, a second top rail soft goods section 124*b* that overlaps the first top end rail assembly 118 and second corner assembly, a third top rail soft goods section 124*c* that overlaps the second top side rail assembly 120 and third corner assembly, and a fourth top rail soft goods section 124*d* that overlaps the second top end rail assembly 122 and fourth corner assembly.

While the top rail soft goods 124 are described herein as being top rail soft goods sections 124*a*-124*d*, this is only for ease of description of the position of each section 124*a*-124*d* of the top rail soft goods 124. The use of the term section with regard to the top rail soft goods 124 is not intended to imply that each section 124*a*-124*d* is separate from each other section 124*a*-124*d*. While it is possible that each section 124*a*-124*d* is separate from each other section 124*a*-124*d*, in other example embodiments, each section 124*a*-124*d* can be integrally formed with each other section 124*a*-124*d* to create a single top rail soft goods 124, or one or more sections 124*a*-124*d* may be divided along a portion of the section 124*a*-124*d* to split the particular section 124*a*-124*d* into two or more subsections of the particular section 124*a*-124*d*.

In certain example embodiments, the overlapping top rail soft goods 124 can define one or more first channels or passageways through which the rail members of the first top side rail assembly 116, first top end rail assembly 118, second top side rail assembly 120, and second top end rail assembly 122 can be inserted and/or extend through. In addition, the top rail soft goods 124 or particular sections 124*a*-124*d* of the top rail soft goods 124 may be stitched or otherwise affixed to the soft goods (e.g., a fabric mesh) that form each side wall/panel 125, 126, 127, 129. As such, the top frame assembly 104, can provide vertical support for each of the side walls/panels 125, 126, 127, 129 via the top rail soft goods 124.

In certain example embodiments, a first support member 108 can include a first end coupled to the fourth corner assembly and a second distal end coupled to at least one of the bottom frame assembly 106 and a first foot assembly. In example embodiments that do not include the bottom frame assembly 106, the second distal end of the first support member 108 may be coupled to a first foot assembly or may be configured to rest upon the ground or other floor surface without being coupled to a bottom frame assembly 106.

In certain example embodiments, a second support member 110 can have a first end coupled to the first corner assembly and a second distal end coupled to at least one of the bottom frame assembly 106 and a second foot assembly. In example embodiments that do not include the bottom frame assembly 106, the second distal end of the second support member 110 may be coupled to a second foot assembly or may be configured to rest upon the ground or other floor surface without being coupled to a bottom frame assembly 106.

In certain example embodiments, a third support member 112 can have a first end coupled to the second corner assembly and a distal second end coupled to at least one of the bottom frame assembly 106 and a third foot assembly. In example embodiments that do not include the bottom frame assembly 106, the second distal end of the third support member 112 may be coupled to a third foot assembly or may be configured to rest upon the ground or other floor surface without being coupled to a bottom frame assembly 106.

In certain example embodiments, a fourth support member 114 can have a first end coupled to the third corner assembly and a distal second end coupled to at least one of the bottom frame assembly 106 and a fourth foot assembly. In example embodiments that do not include the bottom frame assembly 106, the second distal end of the fourth support member 114 may be coupled to a fourth foot assembly or may be configured to rest upon the ground or other floor surface without being coupled to a bottom frame assembly 106.

Each support member 108, 110, 112, 114 may be fixedly or removably coupled to the corresponding corner assembly. Each of the first support member 108, second support member 110, third support member 112, and fourth support member 112 can extend vertically or substantially vertically between the respective corner assembly and at least one of the bottom frame assembly 106 (in embodiment including the assembly 106), the respective foot assembly, and/or the ground or other floor surface and can be configured to provide vertical support to the top side rail assemblies 116, 120, top end rail assemblies 118, 122, and optionally the corner assemblies.

In certain example embodiments, the playard 100 can also include a bottom frame assembly 106. The bottom frame assembly 106 can have any number of configurations to provide vertical support of the base or bottom panel 128 of the playard 100 and, optionally, of the first 108, second 110, third 112, and fourth 114 support members. The bottom frame assembly 106 can include multiple bottom support rail members. Each bottom support rail member can extend horizontally or substantially horizontally when the playard 100 is in the use configuration, as shown in FIG. 1A. The bottom frame assembly 106 can also include a bottom rail folding hub assembly. In one example, the bottom rail folding hub assembly can be centrally or substantially centrally positioned within the bottom frame assembly 106 and with respect to the support members 108, 110, 112, 114. Each, or at least a portion, of the bottom support rails members can be directly or indirectly pivotably coupled to the bottom rail folding hub.

The bottom rail folding hub can also include a pull strap coupled to the bottom rail folding hub 144. The pull strap can be constructed of a fabric material. In certain example embodiments, the pull strap can be formed to create a loop that is configured to receive a hand or portion of a hand therethrough to grip the pull strap. The pull strap can be positioned along the top side of the bottom rail folding hub. In some example embodiments, the pull strap can extend through an opening in the soft goods base or bottom panel 128 of the playard 100. In certain example embodiments, a user can grasp the pull strap and lift the pull strap vertically to pull the bottom rail folding hub up vertically to begin the process of changing the playard 100 from the use configuration to a folded configuration. The above describes just one example way for providing a foldable playard 100. Other alternative methods and mechanical layouts can be provided for folding the playard 100 in other ways known to those of ordinary skill in the art including those shown and described with reference to FIGS. 2A-3B, the description of which is incorporated herein as an alternative embodiment for the playard 100 of FIGS. 1A-1I by reference for providing a foldable playard 100. The folding mechanisms and methods described above are meant only as an example and are not intended to be limiting in any way.

A bassinet base or floor panel can be permanently affixed to the playard 100 in certain example embodiments. For example, as described hereinafter with reference to FIGS. 1B-1I, at least a portion of a bassinet base can be permanently coupled to at least a portion of the top rail soft goods 124. In addition, the bassinet base can be stored in at least a portion of the top rail soft goods 124 when the bassinet is not in use.

Figure 1B:
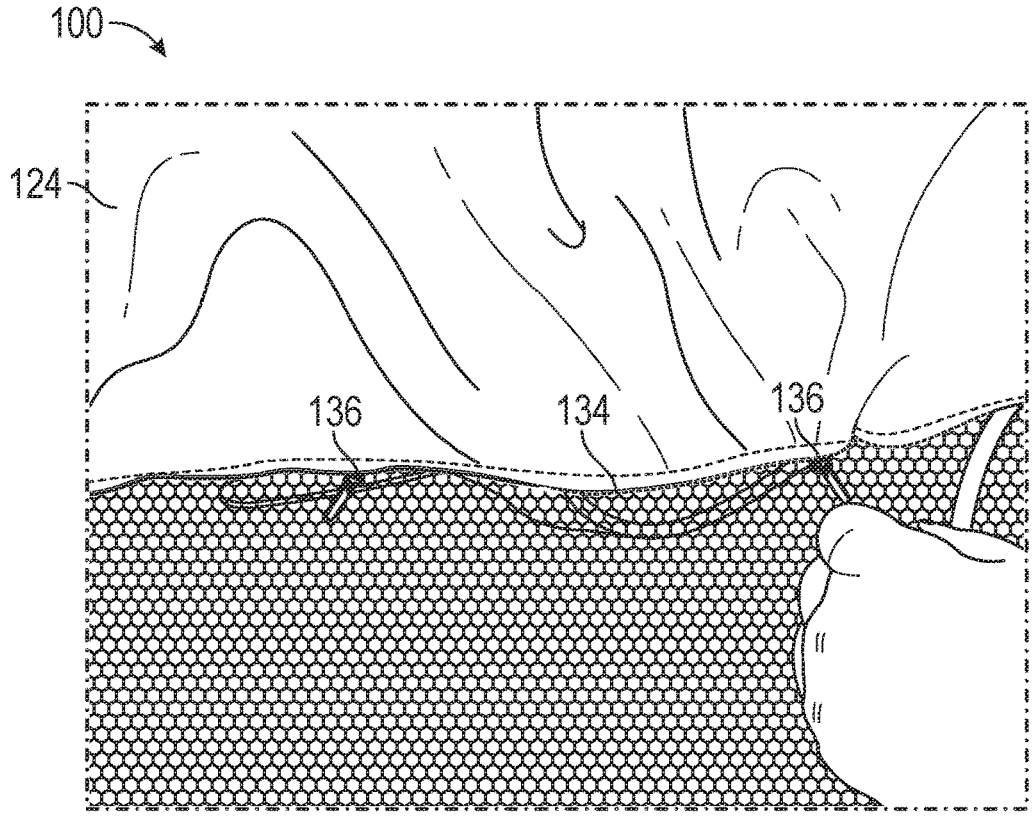
FIG. 1B is a partial side elevation view of the child containment system of FIG. 1A highlighting the mechanism for the opening of a pocket in the soft goods of the child containment system for storing at least a portion of a bassinet, in accordance with one example embodiment of the disclosure.

As shown in FIG. 1B, at least a portion of the top rail soft goods 124 can include a pair of zipper chains or teeth 134 (only one shown). In certain example embodiments, the zipper chains 134 can be generally positioned along a bottom side of the top rail soft goods 124 and along the portion of the top rail soft goods 124 that is positioned along the interior of the playard 100 within the child containment area 130. The zipper chains 134 along each top rail soft goods section 124*a*-124*d* that includes a zipper chain 134 can extend substantially parallel to each other and along the longitudinal axis A1-A4 of the respective top rail soft goods section 124*a*-124*d*. In one example embodiment, each top rail soft goods section 124*a*-124*d* includes a pair of zipper chains 134. In this example embodiment, the pair of zipper chains 134 can extend in a first U-shaped configuration U1 along the fourth top rail soft goods section 124*d*, first top rail soft goods section 124*a*, and second top rail soft goods section 124*b*, as shown in FIG. 1F, and can extend in a second separate U-shaped configuration U2 along the second top rail soft goods section 124*b*, the third top rail soft goods section 124*c*, and the fourth top rail soft goods section 124*d*. In other example embodiments, only the first top rail soft goods section 124*a* includes the pair of zipper chains 134, or only the first top rail soft goods section 124*a* and third top rail soft goods section 124*c* include the pair of zipper chains 134, or only the second top rail soft goods section 124*b* and the fourth top rail soft goods section 124*d* include the pair of zipper chains 134.

Figure 1C:
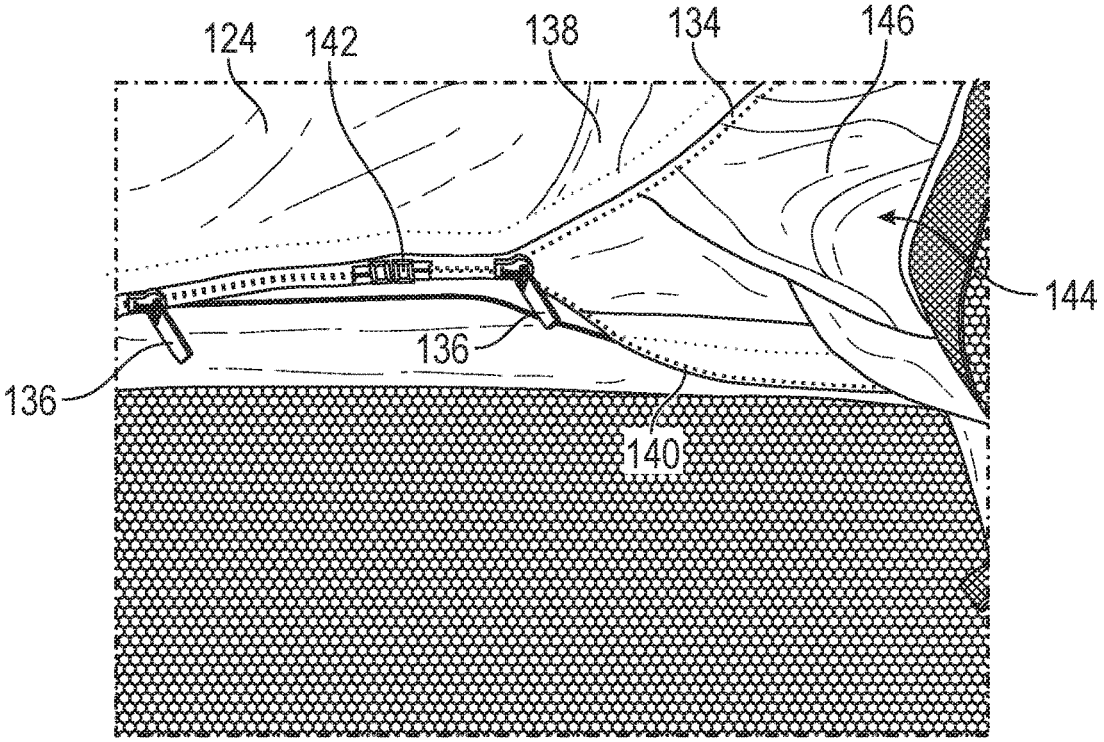
FIG. 1C is a partial side elevation view of the child containment system of FIG. 1A highlighting the interior cavity in the soft goods of the child containment system for storing at least a portion of a bassinet, in accordance with one example embodiment of the disclosure.

Each zipper chain 134 can be provided along opposing edges 138, 140 (as shown in FIG. 1C) of the respective top rail soft goods section 124*a*-124*d*. One or more pulls tabs and sliders 136 can be movably coupled to one of the zipper chains 134 to couple and decouple the zipper chains 134 to one another. A user can manually adjust the pull tab and slider 136 in a first direction to couple the pair of zipper chains 134 together and can manually adjust the pull tab and slider 136 in a second direction opposite the first to decouple the pair of zipper chains 134 from one another. Any number of pull tabs and sliders 136 (e.g., one, two, three, four, or more) can be provided for manually coupling and decoupling the zipper chains 134 provided along the top rail soft goods 124. The example zipper assembly can also include one or more bottom stops or retainer pin boxes 142 that can be positioned on at least one of the zipper chains 134 to either prevent the pull tab and slider 136 from fully decoupling the two opposing zipper chains 134 (the bottom stop) or to provide for an initial alignment and coupling of the two opposing zipper chains 134 for continued coupling by the pull tab and slider 136 (the retainer pin box).

When the zipper chains 134 are decoupled from one another, the opposing edges 138, 140 of the particular top rail soft goods section 124*a*-124*d* can be separated to expose and provide access to an interior cavity 144 of the particular top rail soft goods section 124*a*-124*d*, as shown in FIG. 1C. A first portion of a bassinet base or floor panel 146*a* can be stored within the interior cavity 144 when the bassinet is not in use with the playard 100. While the example embodiment of FIGS. 1A-1I describes zippers being employed to close the opposing top edge 138 and bottom edge 140 of the respective top rail soft goods section 124*a*-124*d* and to provide access to the interior cavity 144, this is for example purposes only as other means for coupling and decoupling the top edge from the bottom edge of the top rail soft goods section including, but not limited to, buttons/button holes, hooks/eyelets, tabs/slots, snap fasteners, or Velcro may be substituted for the zippers to provide access to the interior cavity 144.

Figure 1D:
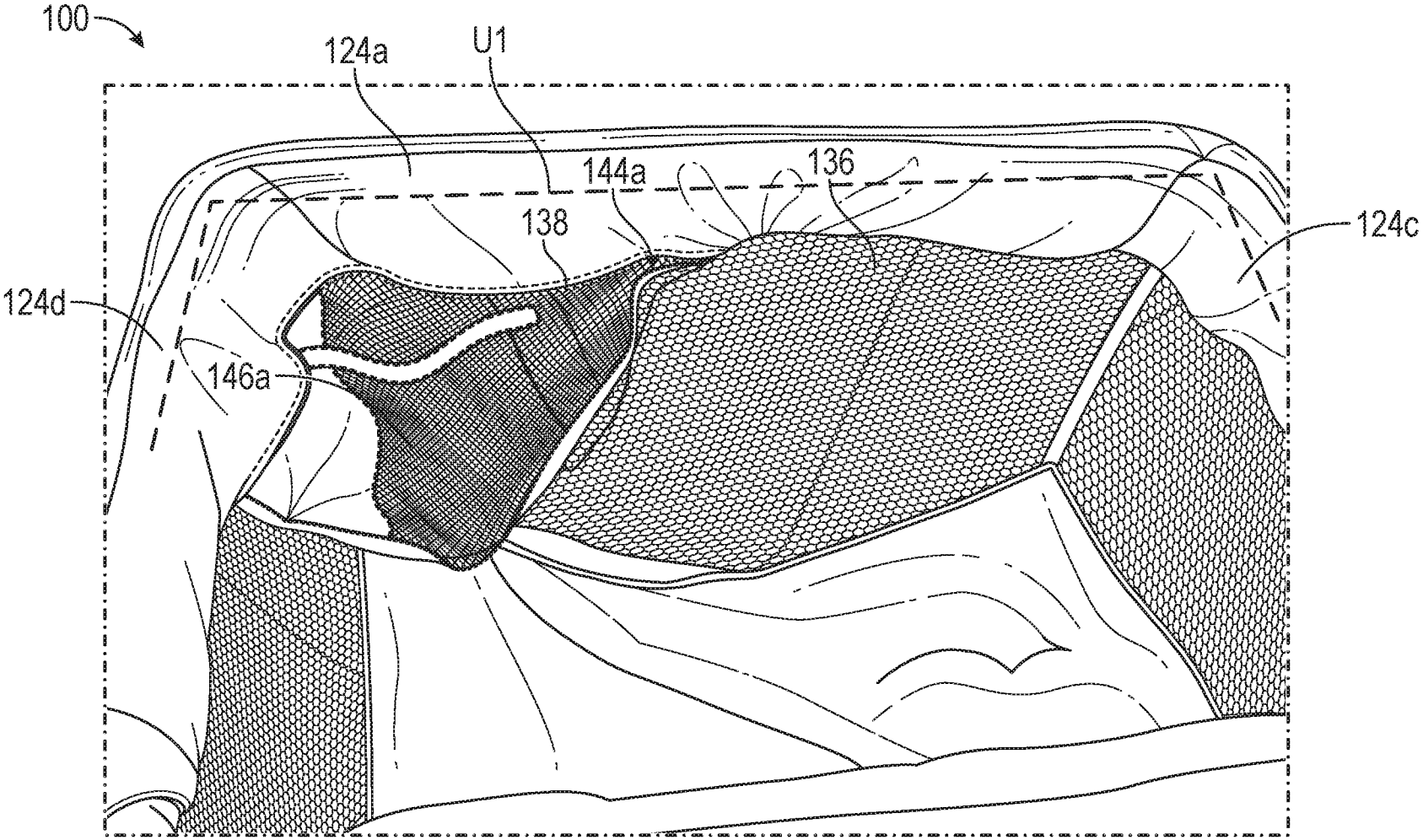
FIG. 1D is a partial perspective view of the child containment system of FIG. 1A showing the removal of at least a portion of a bassinet from the interior cavity of the soft goods of the child containment system, in accordance with one example embodiment of the disclosure.

As shown in FIG. 1D, as the zipper is manually opened by a user with the pull tab and slider 136 along the first U-shaped portion U1 of the zippered soft goods, a first interior cavity 144*a* for a portion of the fourth top rail soft goods section 124*d* and the second top rail soft goods section 124*b* and for the entirety of the first top rail soft goods section 124*a* is made accessible by separating a top edge 138 from the bottom edge 140 of the top rail soft goods 124 for the respective sections 124*a*, 124*b*, and 124*d* and the first partial bassinet base or floor panel 146*a* can be unrolled, unfolded, or otherwise can generally extend out from the first interior cavity 144*a*.

Figure 1E:
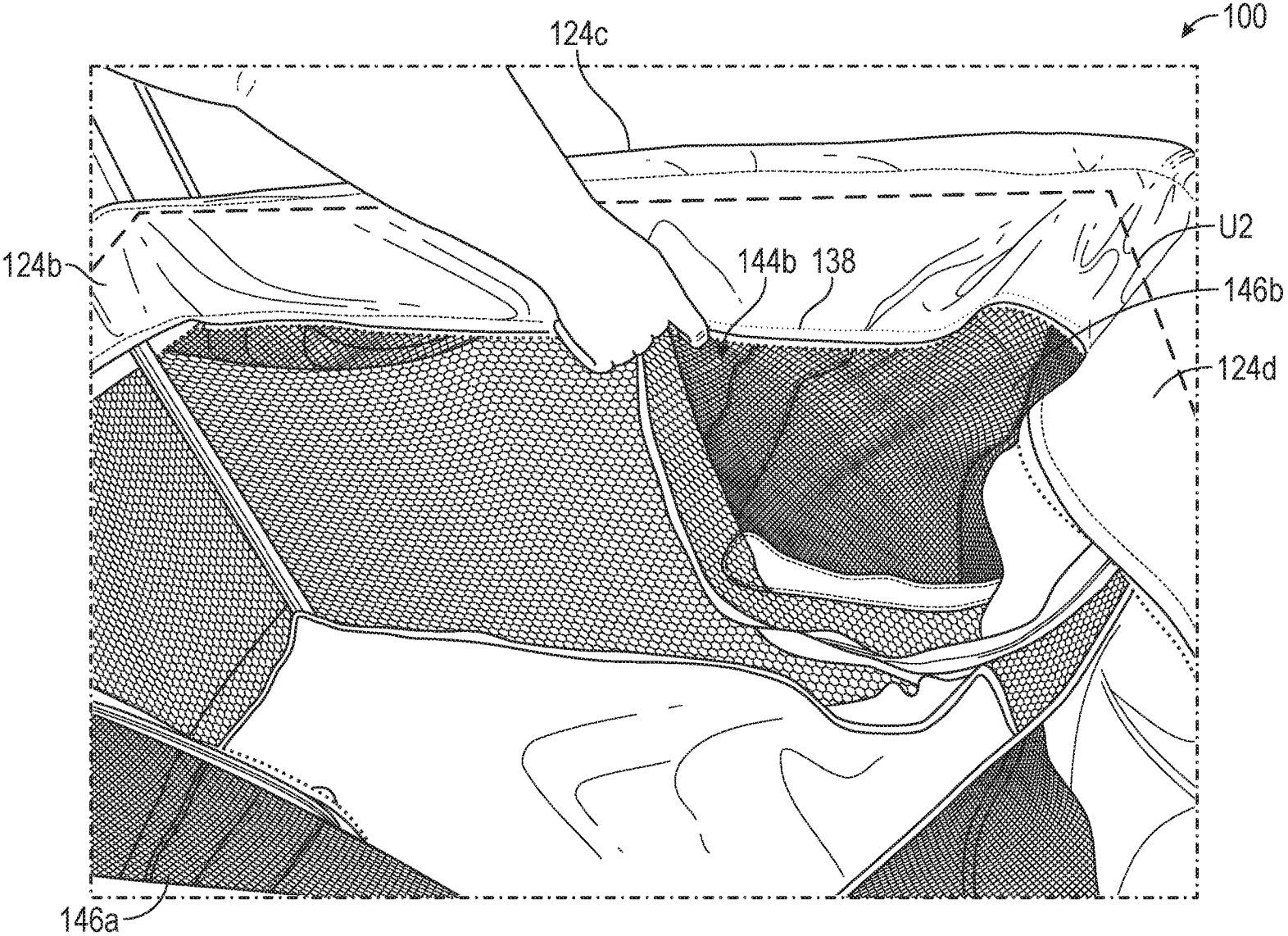
FIG. 1E is a partial perspective view of the child containment system of FIG. 1A showing the removal of at least a second portion of a bassinet from another interior cavity of the soft goods of the child containment system, in accordance with one example embodiment of the disclosure.
Figure 1F:
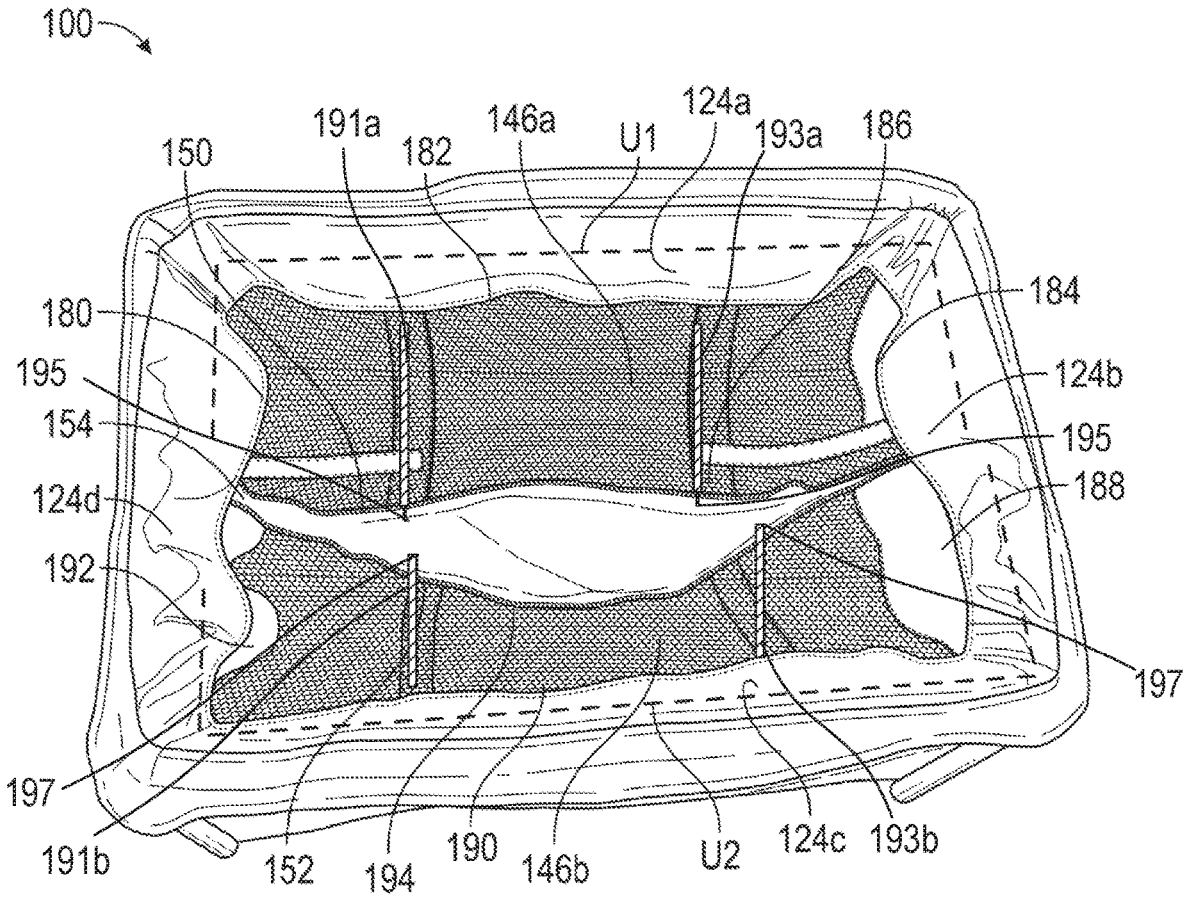
FIG. 1F is a partial perspective view of the child containment system of FIG. 1A presenting two portions of an integrated bassinet in an uncoupled configuration to one another, in accordance with one example embodiment of the disclosure.

Further, as shown in FIG. 1E, as the zipper is manually opened by a user with the pull tab and slider 136 along the second U-shaped portion U2 of the zippered soft goods, a second interior cavity 144*b* for a portion of the fourth top rail soft goods section 124*d* and the second top rail soft goods section 124*b* and for the entirety of the third top rail soft goods section 124*c* is made accessible by separating a top edge 138 from the bottom edge 140 of the top rail soft goods 124 for the respective sections 124*b*, 124*c*, and 124*d* and the second partial bassinet base or floor panel 146*b* can be unrolled, unfolded, or otherwise can generally extend out from the second interior cavity 144*b*. While the example embodiment describes a single zipper pull tab and slider 136 being used for the first U-shaped portion U1 and a single zipper pull tab and slider 136 for the second U-shaped portion U2, this is for example purposes only, as multiple pull tabs and sliders 136 may be alternatively used instead of just one for each U-shaped portion U1 and U2.

As best shown in FIG. 1F, each of the first partial bassinet base or floor panel 146*a* and the second partial bassinet base or floor panel 146*b* can be made from any type of soft goods, such as any combination of fabric material, plastic material, see-through mesh material, or any other material known to those of ordinary skill in the art.

In addition, each of the first partial bassinet base or floor panel 146*a* and second partial bassinet base or floor panel 146*b* can include a mattress support structure 191, 193 coupled to the respective base or floor panel 146*a*, 146*b*. In one example, the mattress support structure includes one or more spaced apart stiffeners 191, 193. In one example, the spaced apart stiffeners are arranged crosswise (e.g., across the width or shorter axis (e.g., extending generally in a direction orthogonal or substantially orthogonal to the longitudinal axis of the first top side rail assembly 116 and the second top side rail assembly 120)) along the respective base or floor panel 146*a*, 146*b*. In another example embodiment, the spaced apart stiffeners 191, 193 are arranged lengthwise (e.g., opposite of crosswise and in a direction parallel or substantially parallel to the longitudinal axis of the first top side rail assembly 116 and the second top side rail assembly 120) along the base floor or panel 146. In certain examples, each stiffener 191, 193 can include a tube or other elongated member with two or more tube segments (e.g., 191*a*, 191*b* for stiffener 191 and 193*a*, 193*b* for stiffener 193). For example, a first pair of tube segments 191*a*, 193*a* can be coupled to the bassinet base or floor panel 146*a* and a second pair of tube segments 191*b* 193*b* can be coupled to the bassinet base or floor panel 146*b*. A first one of the first pair of tube segments 191*a* can be removably coupled to a first one of the second pair of tube segments 191*b* and a second one of the first pair of tube segments 193*a* can be removably coupled to a second one of the second pair of tube segments 193*b* to each extend across the width or length of the bassinet base or floor panel 146. In certain other example embodiments, a distal end of at least two of the tube segments 191*a*, 191*b*, 193*a*, 193*b* is irremovably attached to either the top surface or the bottom surface of the respective base or floor panel 146*a*, 146*b*. For example, each outer facing end of each of the tube segments 191*a*, 191*b*, 193*a*, 193*b* can be coupled to the bassinet base or floor panel 146 by riveting, stitching or another coupling technique. In other example embodiments, none of the tube segments 191*a*, 191*b*, 193*a*, 193*b* is irremovably attached to the respective base or floor panel 146*a*, 146*b*. Each of the tub segments 191*a*, 191*b*, 193*a*, 193*b* may be stored within the first interior cavity 144*a* and the second interior cavity 144*b* when the bassinet base or floor panel 146 is stored within the first interior cavity 144*a* and second interior cavity 144*b*. For example, the tube segments 191*a*, 193*a* can be stored within the first interior cavity 144*a* and the tube segments 191*b*, 193*b* can be stored within the second interior cavity 144*b*.

In certain example embodiments, at least one of the tube segments 191*a*, 191*b*, 193*a*, 193*b* of each stiffener 191, 193 can include a proximal end 195 that is swaged or tapered to a diameter that is smaller than the diameter of the proximal end 197 of the other tube segments of the tube segments 191*a*, 191*b*, 193*a*, 193*b*. When the first partial base or floor panel 146*a* and second partial base or floor panel 146*b* extend out from the cavity and are coupled together for use of the bassinet, the smaller swaged ends 195 can be inserted into the larger ends 197 to engage and removably couple the tube segments 191*a*, 191*b*, 193*a*, 193*b* of the stiffeners. In certain other examples, the proximal ends of the tube segments 191*a*, 191*b*, 193*a*, 193*b* can include a suitable locking mechanism, such as a VALCO ball arrangement, to releasably secure the tube segments 191*a*, 191*b*, 193*a*, 193*b* together (e.g., 191*a* to 191*b* and 193*a* to 193*b*). The stiffeners 191, 193 in their coupled state are configured to provide support for the mattress pad 132 and to help keep the mattress pad 132 in a generally flat state when the mattress pad 132 is placed on top of the top surface of the first partial bassinet base or floor panel 146*a* and the second partial bassinet base or floor panel 146*b*, as shown in FIG. 1I.

As shown in FIG. 1F, in one example embodiment, the first partial bassinet base or floor panel 146*a* can have a first side 180 permanently coupled to the fourth top rail soft goods section 124*d*, a second side 182 permanently coupled to the first top rail soft goods section 124*a*, a third side 184 permanently coupled to the second top rail soft goods section 124*b* and opposite the first side 180, and a fourth side 186 that is opposite the second side 182 and is initially free from coupling but configured to be removably coupled to the second partial bassinet base or floor panel 146*b*. In one example, the first partial bassinet base or floor panel 146*a* has a generally or substantially rectangular shape, however, the base or floor panel 146*a* can have any other shape including, but not limited to, semi-circular or half of an oval. In one example, the first side 180, second side 182, and third side 184 are permanently coupled to the respective sections of the top rail soft goods 124 by being sewn to those sections. Alternatively, the first side 180, second side 182, and third side 184 may be integrally formed with the respective sections of the top rail soft goods 124, riveted to the respective sections of the top rail soft goods 124, or adhered to the respective sections of the top rail soft goods 124 using an adhesive or heat welding.

The fourth side 186 of the first partial bassinet base or floor panel 146*a* can further include a first means for coupling the first partial bassinet base or floor panel 146*a* to the second partial bassinet base or floor panel 146*b*. In certain examples, the first means for coupling is a zipper chain 150 and optionally a pull tab and slider 154 (see FIG. 1G) movably coupled to the zipper chain 150. In addition, the first means for coupling can also include a zipper pin box (not shown) for aligning the two zipper chains 150, 152 for coupling together. In one example, the zipper chain 150 can extend along the entire or substantially the entire length of the fourth side 186. In other example embodiments, the first means for coupling can include hooks and eyelets, buttons and button holes, tabs and slots, VELCRO, multiple snap fasteners, or any combination thereof.

In one example embodiment, the second partial bassinet base or floor panel 146*b* can have a first side 188 permanently coupled to the second top rail soft goods section 124*b*, a second side 190 permanently coupled to the third top rail soft goods section 124*c*, a third side 192 permanently coupled to the fourth top rail soft goods section 124*d* and opposite the first side 188, and a fourth side 194 that is opposite the second side 190 and is initially free from coupling but configured to be removably coupled to the fourth side 186 of the first partial bassinet base or floor panel 146*a*. In one example, the second partial bassinet base or floor panel 146*b* has a generally or substantially rectangular shape, however, the base or floor panel 146*b* can have any other shape including, but not limited to, semi-circular or half of an oval. In one example, the first side 188, second side 190, and third side 192 are permanently coupled to the respective sections of the top rail soft goods 124 by being sewn to those sections. Alternatively, the first side 188, second side 190, and third side 192 may be integrally formed with the respective sections of the top rail soft goods 124, riveted to the respective sections of the top rail soft goods 124, or adhered to the respective sections of the top rail soft goods 124 using an adhesive or heat welding.

The fourth side 194 of the second partial bassinet base or floor panel 146*b* can further include a second means for coupling the second partial bassinet base or floor panel 146*b* to the fourth side 186 of the first partial bassinet base or floor panel 146*a*. In certain examples, the second means for coupling is a zipper chain 152 and optionally a pull tab and slider 154 (see FIG. 1G) movably coupled to the zipper chain 152. In addition, the second means for coupling can also include a zipper pin box (not shown) for aligning the two zipper chains 150, 152 for coupling together. In one example, the zipper chain 152 can extend along the entire or substantially the entire length of the fourth side 194. In other example embodiments, the first and second means for coupling can be hooks and eyelets, buttons and button holes, tabs and slots, or multiple snap fasteners. In other example embodiments, the second means for coupling can include hooks and eyelets, buttons and button holes, tabs and slots, VELCRO, multiple snap fasteners, or any combination thereof.

Figure 1G:
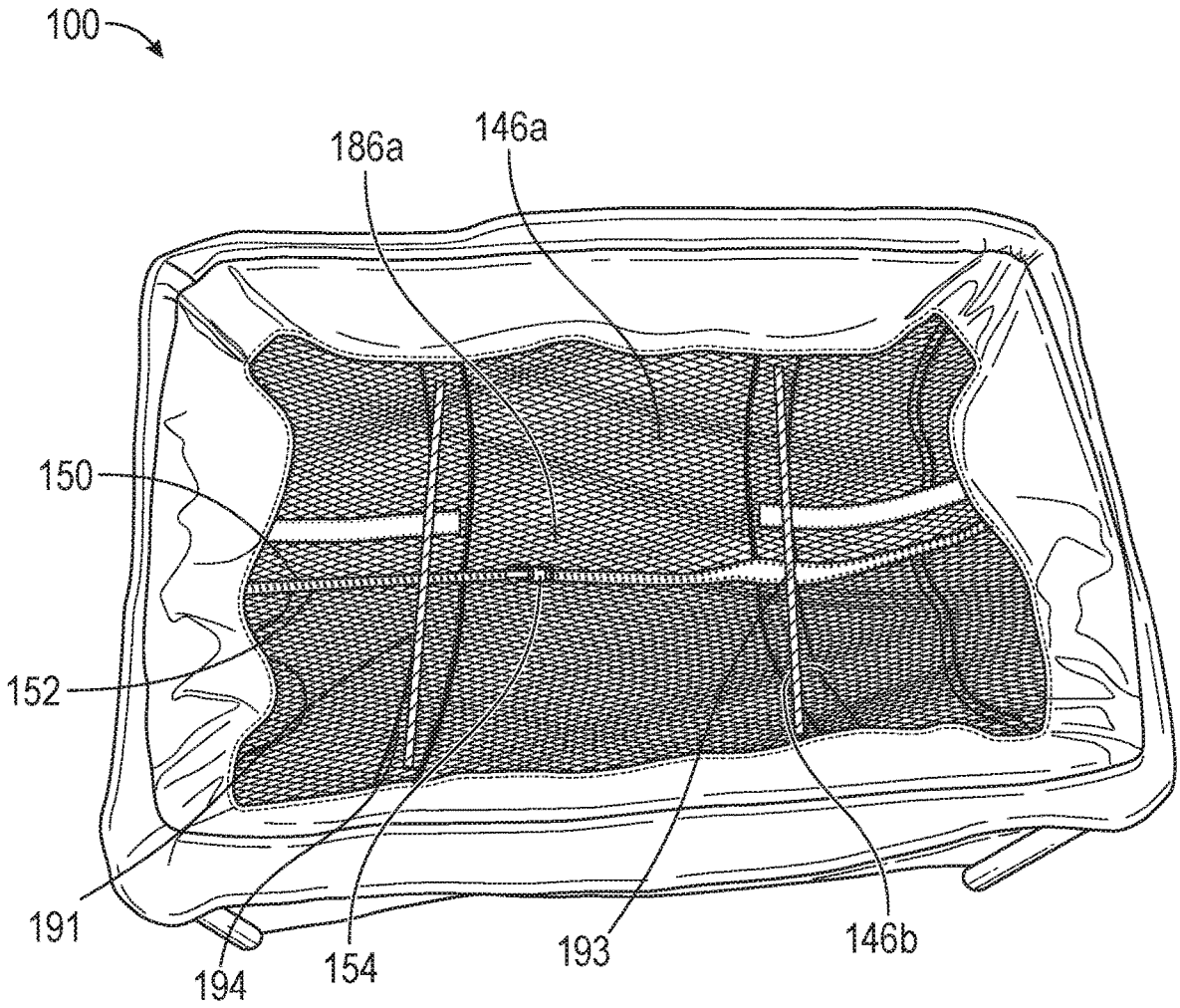
FIG. 1G is a partial perspective view of the child containment system of FIG. 1A showing the partial coupling of the two portions of an integrated bassinet to one another, in accordance with one example embodiment of the disclosure.
Figure 1H:
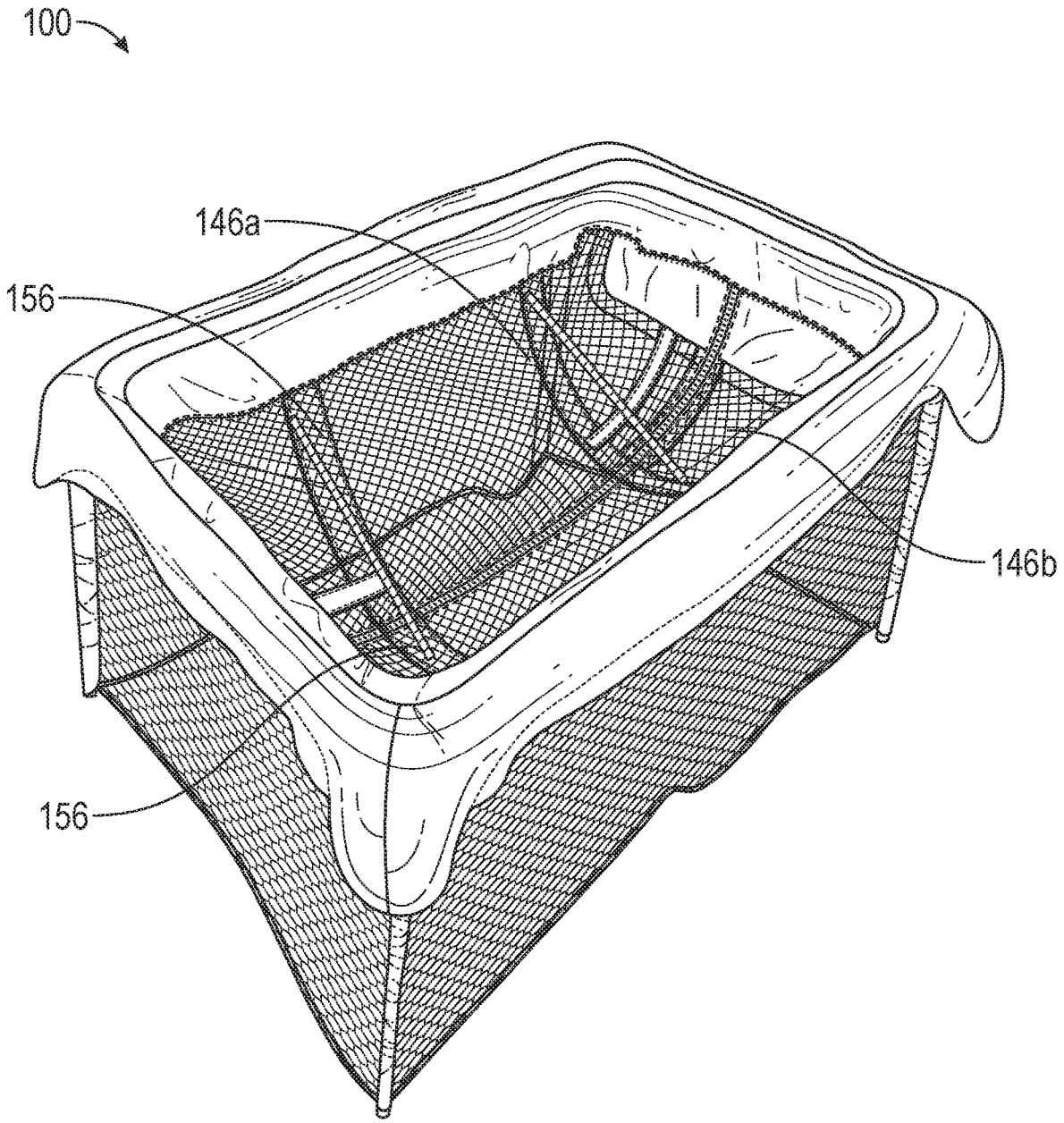
FIG. 1H is a partial perspective view of the child containment system of FIG. 1A showing a bassinet in a use configuration with the two portions of the integrated bassinet in a coupled configuration to one another, in accordance with one example embodiment of the disclosure.
Figure 1I:
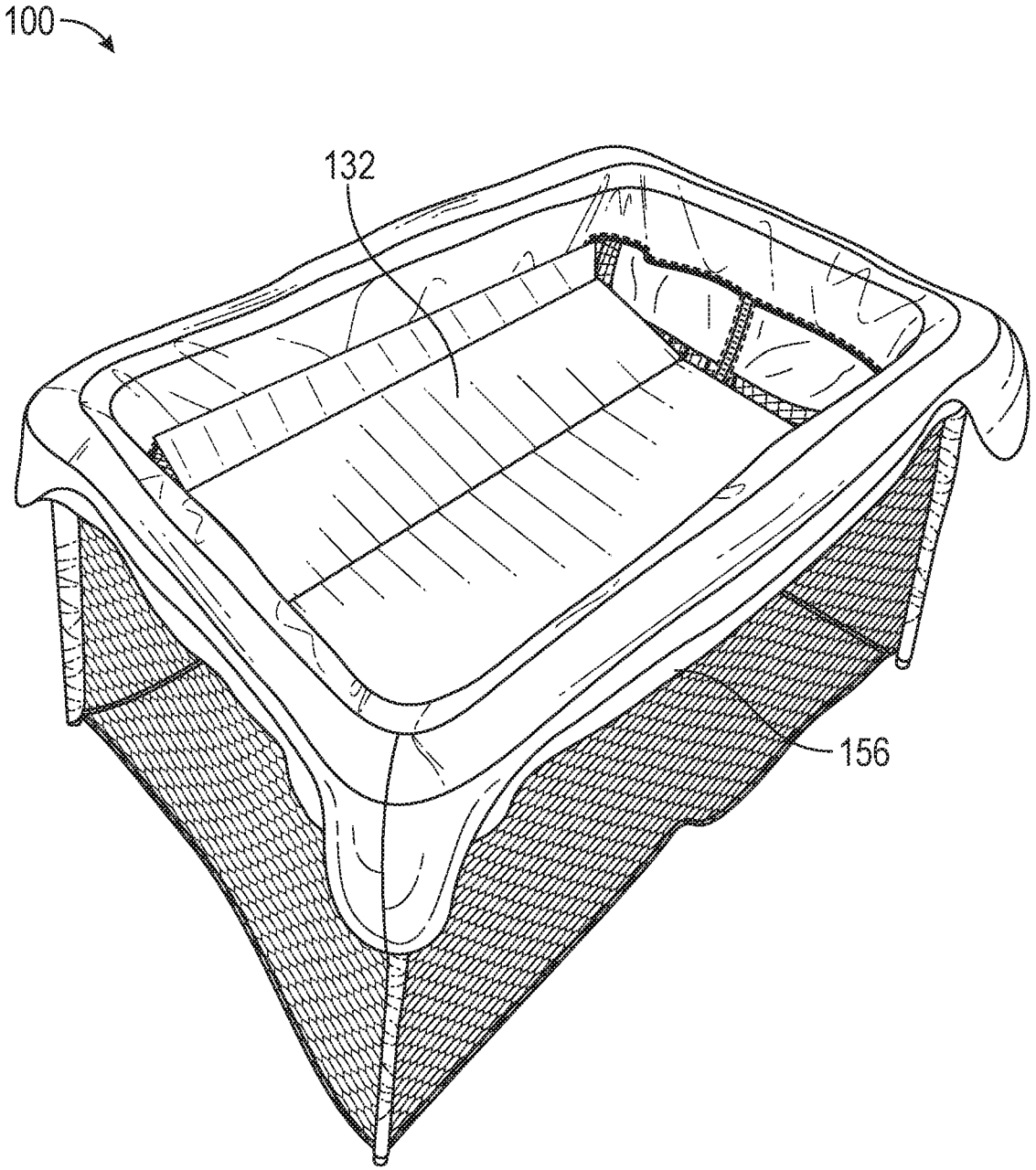
FIG. 1I is a partial perspective view of the child containment system of FIG. 1A showing a bassinet in a use configuration with padding placed on top of a portion of the bassinet, in accordance with one example embodiment of the disclosure.

As shown in FIGS. 1G-1H, the first partial bassinet base or floor panel 146*a* can be removably coupled to the second partial bassinet base or floor panel 146*b*. For example, the zipper chain 150 of the fourth side 186 of the first partial bassinet base or floor panel 146*a* can be removably coupled to the zipper chain 152 of the fourth side 194 of the second partial bassinet base or floor panel 146*b* using a pull tab and slider 154 to couple the zipper chains 150, 152 together.

When the first partial bassinet base or floor panel 146*a* is coupled to the second partial bassinet base or floor panel 146*b*, the result is a unified base or floor panel that provides a support surface for supporting the mattress pad 132 (see FIG. 1I) or any other bassinet features. The mattress pad 132 can be positioned upon the top surface of the unified base or floor panel and can be configured to receive an infant or small child thereon.

In one example embodiment, the mattress pad 132 can be foldable and can have a substantially U-shaped shape when unfolded and placed on top of the bassinet base or floor panel. In this embodiment, the mattress pad 132 can include a central horizontal portion, a first vertically upward extending portion along one lateral side of the central horizontal portion and a second vertically upward extending portion along a second lateral side of the central horizontal portion to create U-shape. In one example, the first vertically upward extending portion and the second vertically upward extending portion are coupled to one or more straps provided on the soft goods to hold maintain the substantially vertical positioning of the first vertically upward extending portion and the second vertically upward extending portion.

In this example embodiment, when the user no longer needs to use the bassinet portion of the playard 100, the user can unzip or otherwise decouple the first partial bassinet base or floor panel 146*a* from the second partial bassinet base or floor panel 146*b*. The user can then fold, roll or otherwise compress the first partial bassinet base or floor panel 146*a* into the interior cavity 144 of the first top rail soft goods section 124*a* and a portion of each of the fourth top rail soft goods section 124*d* and the second top rail soft goods section 124*b*. The user can also fold, roll or otherwise compress the second partial bassinet base or floor panel 146*b* into the interior cavity 144 of the third top rail soft goods section 124*c* and a portion of each of the fourth top rail soft goods section 124*d* and the second top rail soft goods section 124*b*. The user can then close the access to the interior cavity 144 by removably coupling the zipper chains 134 using the pull-tab and slide 136 to store the first 146*a* and second 146*b* partial bassinet base or floor panels within the interior cavity 144.

While the example embodiment of FIGS. 1A-1I present two partial bassinet bases or floor panels 146*a*, 146*b* that are permanently coupled to a portion of the top rail soft goods 124 and removably coupled to one another, this is for example purposes only as other embodiments may exist. For example, in an alternate embodiment, a single bassinet base or floor panel (not shown) may be substituted for the two partial bassinet bases or floor panels 146*a*, 146*b*.

In the alternate embodiment, the single bassinet base or floor panel may have one side permanently coupled to the top rail soft goods 124 in the manner substantially the same as described above. In one example, the single bassinet base or floor panel may be permanently coupled to the first top rail soft goods section 124*a* or any other section of the top rail soft goods 124. The other three remaining sides of the single bassinet base or floor panel may include a third means for coupling the single bassinet base or floor panel to the remaining three top rail soft goods sections (e.g., 124*b*, 124*c*, and 124*d*). In certain examples, the third means for coupling is a zipper chain that extends along all or substantially all of the outer perimeter of the other three sides of the single bassinet base or floor panel that are not permanently coupled to the top rail soft goods 124, and optionally a pull tab and slider movably coupled to the zipper chain. The single bassinet base or floor panel may be stored when not in use in the interior cavity 144 of the first top rail soft goods section 124*a*. When use of the bassinet is desired, the user can removably couple the remaining free three sides of the single bassinet base or floor panel to zipper chains provided on the remaining three sections of the top rail soft goods 124 (e.g., 124*b*, 124*c*, and 124*d*) using one or more pull tabs and sliders. In addition, the third means for coupling can also include a zipper pin box (not shown) for aligning the zipper chain on the single bassinet base or floor panel to the zipper chain on the remaining three sections of the top rail soft goods 124 for coupling together. Alternatively, the third means for coupling can include hooks and eyelets, buttons and button holes, tabs and slots, VELCRO, or multiple snap fasteners to removably coupled the three free sides of the single bassinet base or floor panel to the three respective sections of the top rail soft goods 124.

In this alternative embodiment, when the user no longer needs to use the bassinet portion of the playard 100, the user can unzip or otherwise decouple the three free sides of the single bassinet base or floor panel from the three respective sections of the top rail soft goods 124. The user can then fold, roll or otherwise compress the single bassinet base or floor panel into the interior cavity 144 of the first top rail soft goods section 124*a*. The user can then close the access to the interior cavity 144 by removably coupling the zipper chains 134 using the pull-tab and slide 136 to store the single bassinet base or floor panel within the interior cavity 144.

FIGS. 2A-3B present a variety of perspective views of a child containment system 200 and a frame assembly 202 for use in the child containment system 200. In one example, the child containment system 200 can be the child containment system 100 shown and described with reference to FIGS. 1A-1I, including the soft goods and integrated bassinet shown and described above. However, in other examples, the child containment system 200 incorporating the frame assembly 202 can be another type of child containment system and may or may not include the integrated bassinet. This other embodiment of the child containment system 200 can still include the end walls/panels 227, 231; side walls/panels 225, 229; and base wall/panel 233 that are similar or same as those shown and described in FIGS. 1A-1I with reference to the end 127, 129; side 125, 126; and base 128 walls/panels, the description of which is incorporated herein by reference. Further, each of these end 227, 231; side 225, 229; and base 233 walls/panels can be generally formed of soft goods, such as any combination of fabric material, plastic material, see-through mesh material, or any other material known to those of ordinary skill in the art.

Figure 2A:
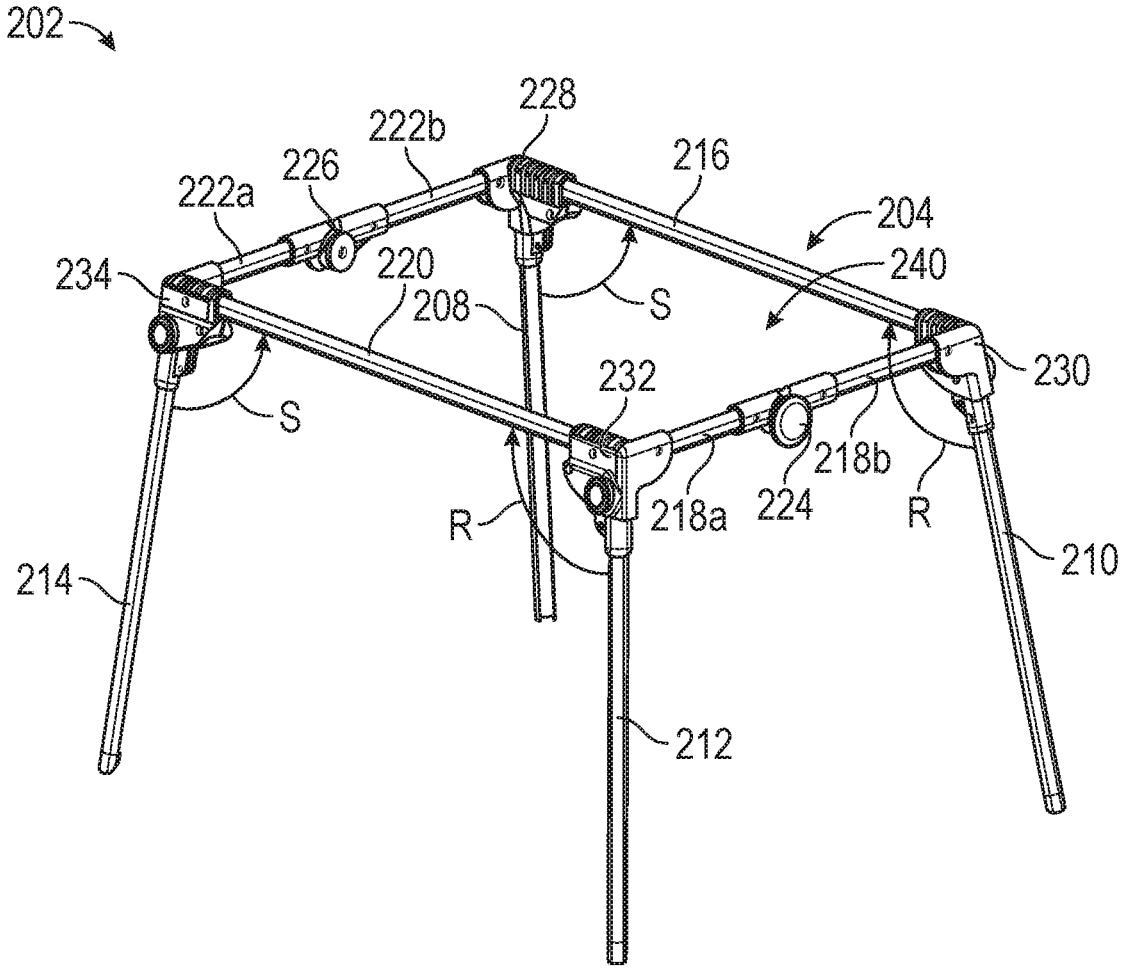
FIG. 2A is a perspective view of a frame assembly for a child containment system, in accordance with one example embodiment of the disclosure.
Figure 2B:
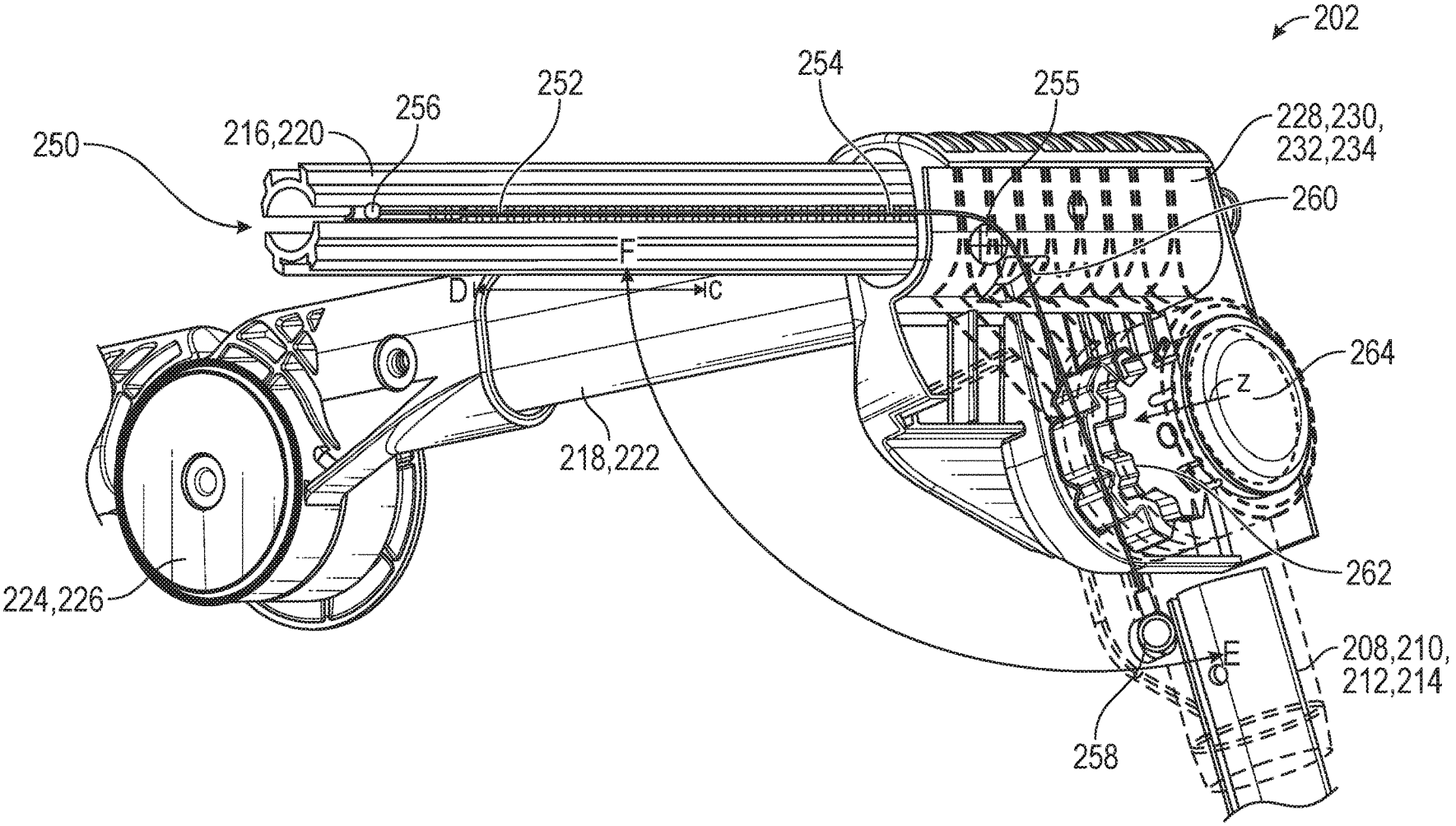
FIG. 2B is a partial perspective view of the frame assembly of FIG. 2A, in accordance with one example embodiment of the disclosure.
Figure 2C:
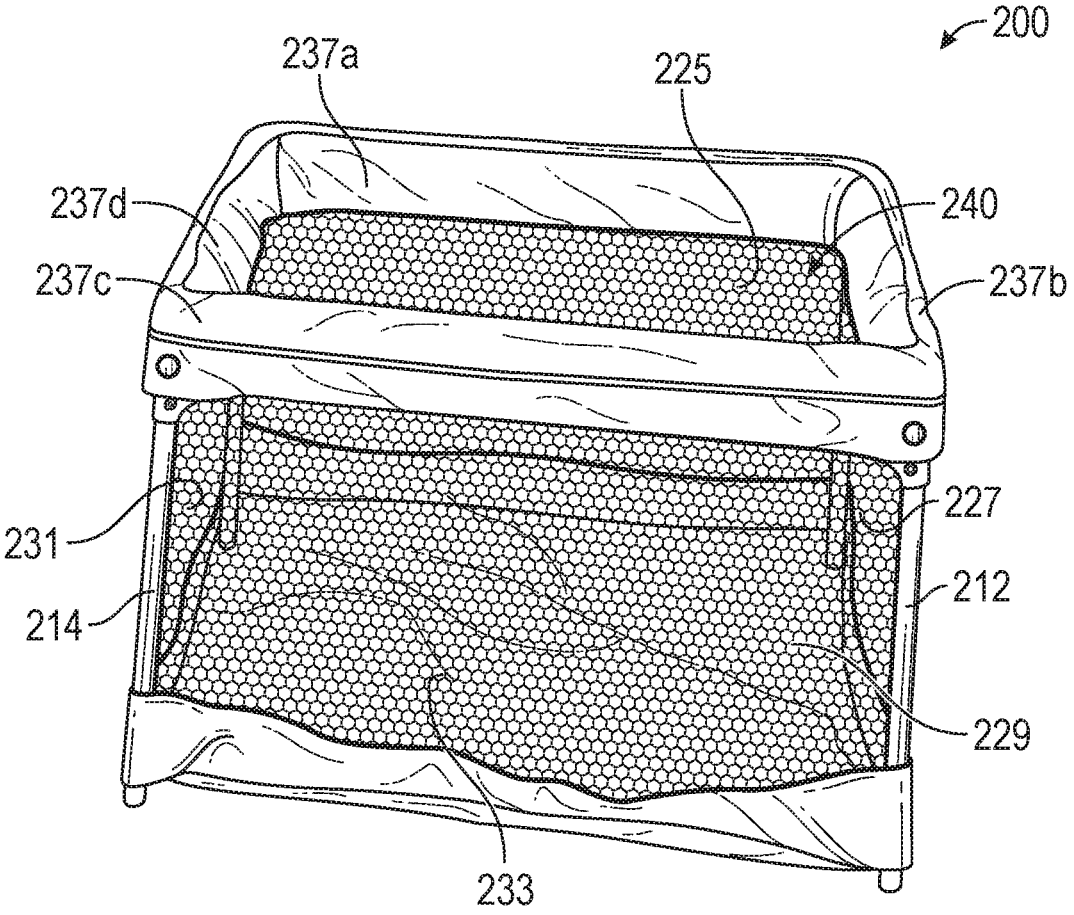
FIG. 2C is a perspective view of the child containment system of FIGS. 2A-B, in accordance with one example embodiment of the disclosure.

Referring to FIGS. 2A-2C, the playard 200, referred to hereinafter as both an "child containment system" and "playard" for example, can include a frame assembly 202 that supports and defines a play surface suspended above a floor or other ground surface. As shown in FIGS. 2A and 2C, the example frame assembly 202 defines a play surface that has rectangular or substantially rectangular base or bottom panel 233, a pair of opposed side walls or panels 225, 229, and a pair of opposed end walls or panels 227, 231. While the example frame assembly 202 is shown and described as having a rectangular shape, this is for example purposes only, as the bottom panel 233 can have any shape, including but not limited to square, circular, oval, triangular, hexagonal, etc. and the frame assembly 202 can have any number of walls/panels, including a single side wall/panel defining a circular or oval play surface. The walls/panels 225, 227, 229, 231 can extend upward from the generally flat or horizontal base panel 233 to surround the play surface and define a first child containment area 240 for an infant or toddler. The end 227, 231; side 225, 229; and base 233 walls/panels can be suspended from or otherwise supported by the frame assembly 202. In one example, at least a portion of the frame assembly 202 can be covered by fabric or another form of soft goods and can thus be largely concealed from view. In addition, a mattress pad (not shown) or other cushion can be positioned along the top surface of the base or bottom panel 233 and cover substantially all of the top side surface area of the base or bottom panel 233 and can be configured to receive a child thereon.

In one example, as shown in FIG. 2A, the frame assembly 202 can include a top rail assembly 204 and a number of support members 208, 210, 212, 214 extending generally downward from the top rail assembly 204 when the playard 200 is in the use configuration, as shown in FIGS. 2A and 2C. In one example, each of the support members 208, 210, 212, and 214 can extend vertically or substantially vertically from the top rail assembly 204 when the frame assembly 202 is in the use configuration. In other examples, the support members 208, 210, 212, 214 may be at any angle less than 30 degrees offset from a vertical position when the frame assembly 202 is in the use configuration. In certain examples, each support member 208, 210, 212, 214 may be referred to as a "leg" or "leg member". Each of the top rail assembly 204 and support members 208, 210, 212, 214, can be made of metal, plastic, or a combination thereof. In certain examples, at least a portion of the top rail assembly 204 and support members 208, 210, 212, 214 include elongated solid or hollow tubular rod members.

In certain examples, the top rail assembly 204 can include a first top end rail assembly 218 and a second top end rail assembly 222. The first top end rail assembly 218 and second top end rail assembly 212 can be positioned generally along a top portion of the corresponding end walls/panels 227, 231 respectively. In certain example embodiments, each of the first top end rail assembly 218 and the second top end rail assembly 222 can be constructed of a single rail member, a pair of rail members, or more than two rail members. In example embodiments where the first top end rail assembly 218 and second top end rail assembly 222 include two or more rail members (e.g., a first top end rail member 218*a*, a second top end rail member 218*b*, a third top end rail member 222*a*, and a fourth top end rail member 222*b*), the rail members may be pivotable with respect to one-another (e.g., the first top end rail member 218*a* may be pivotable with respect to the second top end rail member 218*b* and the third top end rail member 222*a* may be pivotable with respect to the fourth top end rail member 222*b*) and optionally with respect to the adjacent support members 208, 210, 212, and 214 and the assembly 202 may include rail locking mechanisms 224, 226 that are positioned between and coupled to the rail members (e.g., a first top end rail member 218*a*, a second top end rail member 218*b*, a third top end rail member 222*a*, and a fourth top end rail member 222*b*) at their respective ends to allow each rail member (e.g., a first top end rail member 218*a*, a second top end rail member 218*b*, a third top end rail member 222*a*, and a fourth top end rail member 222*b*) to pivot with respect to the rail locking mechanism 224, 226. Each of the top end rail assemblies 218, 222 can be constructed of plastic, metal or a combination thereof and each of the top end rail members (e.g., a first top end rail member 218*a*, a second top end rail member 218*b*, a third top end rail member 222*a*, and a fourth top end rail member 222*b*) can be a solid, tubular, or substantially tubular member that includes a hollow channel extending from a first end to an opposing second end of the respective top end rail member.

The top frame assembly 204 can further include a first top side rail assembly 216 and an opposing second top side rail assembly 220. Each of the first top side rail assembly 216 and the second top side rail assembly 220 can be positioned generally along a top portion of the corresponding side walls/panels 225, 229 respectively. In certain example embodiments, each of the first top side rail assembly 216 and the second top side rail assembly 220 can be constructed of a single rail member, a pair of rail members, or more than two rail members. In example embodiments where the first top side rail assembly 216 and second top side rail assembly 220 include two or more rail members, the rail members may be pivotable with respect to one-another and optionally with respect to the adjacent support members 208, 210, 212, and 214 and/or the adjacent top end rail assembly 218, 222 and the assembly 216, 220 may include rail locking mechanisms (not shown) that are positioned between and coupled to the rail members at their respective ends to allow each rail member to pivot with respect to the rail locking mechanism. Each of the top side rail assemblies 216, 220 can be constructed of plastic, metal or a combination thereof and each of the top side rail members 216, 220 can be a solid, tubular, or substantially tubular member that includes a hollow channel extending from a first end to an opposing second end of the respective top side rail member. Each of the top side rail assemblies 216, 220 can have a first end and a distal second end and can extend generally in a horizontal or substantially horizontal manner from the first top end rail assembly 218 to the second top end rail assembly 222 when the frame assembly 202 is in the use configuration.

In one example embodiment, the frame assembly 202 can include one or more corner assemblies. The number of corner assemblies is variable and based on the number of side walls that the playard may include. In the example of FIGS. 2A-2C, the frame assembly can include a first corner assembly 228, a second corner assembly 230, a third corner assembly 232, and a fourth corner assembly 234. Each of the corner assemblies (e.g., corner assemblies 228, 230, 232, and 234) can be constructed in any manner known to those of ordinary skill in the art, including, but not limited to, that shown and described with reference to FIGS. 2A-3B, such that the top end rail assemblies 218, 222 and/or the top side rail assemblies 216, 220 may be, if desired, pivotable or fixed with respect to the corresponding corner assembly.

In certain example embodiments, the first top side rail assembly 216 can have a first end pivotably or fixedly coupled to the first corner assembly 228 and a distal second end pivotably or fixedly coupled to the second corner assembly 230. In one example, the first top side rail assembly 216 does not pivot with respect to the first corner assembly 228 and the second corner assembly 230.

Figure 3A:
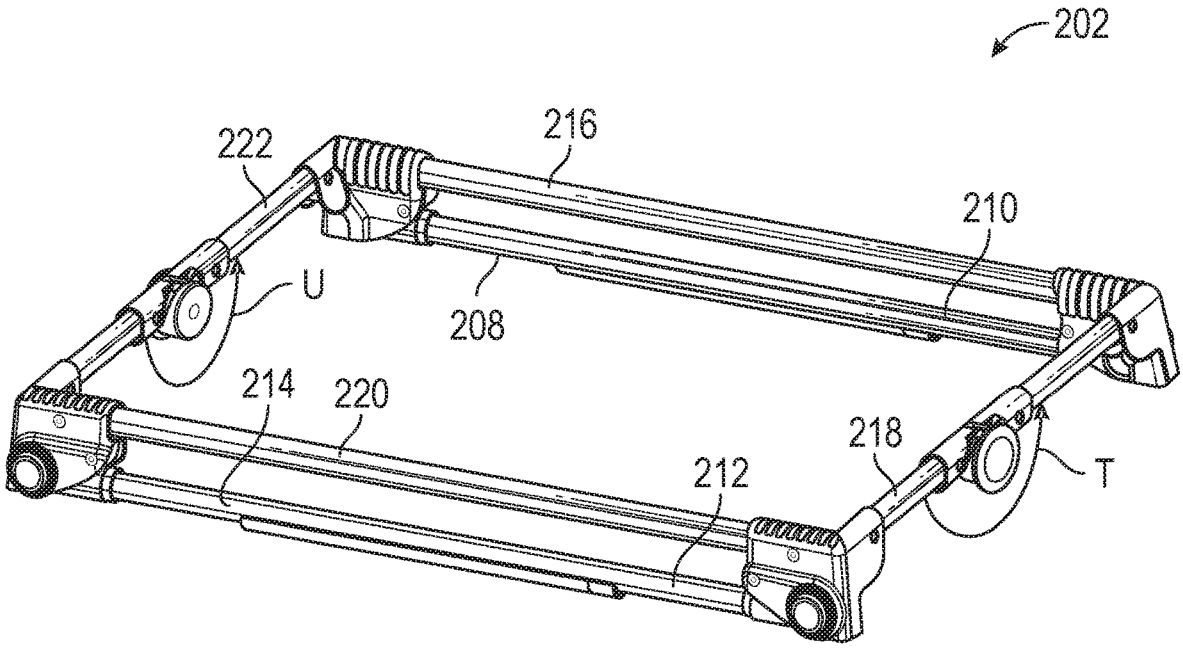
FIG. 3A is a perspective view of the frame assembly of FIG. 2A in a partially folded configuration, in accordance with one example embodiment of the disclosure.

A first support member 208 can have a first end pivotably coupled to the first corner assembly 228 and a distal second end. In one example, the second end of the first support member 208 can be configured to contact the ground or other flooring surface. The first support member 208 can pivot along the arc-path S about a first rotation axis at the pivotable coupling to the first corner assembly 228 from a use configuration (as shown in FIGS. 2A and 2C) to a stored configuration (as shown in FIG. 3A) and from the stored configuration back to the use configuration. In the stored configuration, the longitudinal axis of the first support member 208 is parallel or substantially parallel with the longitudinal axis of the first top side rail assembly 216.

A second support member 210 can have a first end pivotably coupled to the second corner assembly 230 and a distal second end. In one example, the second end of the second support member 210 can be configured to contact the ground or other flooring surface. The second support member 210 can pivot along the arc-path R about a second rotation axis at the pivotable coupling to the second corner assembly 230 from a use configuration (as shown in FIGS. 2A and 2C) to a stored configuration (as shown in FIG. 3A) and from the stored configuration back to the use configuration. In the stored configuration, the longitudinal axis of the second support member 210 is parallel or substantially parallel with the longitudinal axis of the first top side rail assembly 216 and the first support member 208. In certain example embodiments, the first rotation axis and the second rotation axis are parallel or substantially parallel to one another.

In certain example embodiments, the first top end rail assembly 218 can have a first top end rail member 218*a* having a first end pivotably or fixedly coupled to the third corner assembly 232 and a second distal end pivotably or fixedly coupled to the first rail locking mechanism 224. In one example, the first top end rail member 218*a* can be fixedly coupled to the third corner assembly 232 and pivotably coupled to the first rail locking mechanism 224 and pivotable along the arc-path T about a third rotation axis at the pivotable coupling to the first rail locking mechanism 224.

The first top end rail assembly 218 can also have a second top end rail member 218*b* having a first end pivotably or fixedly coupled to the second corner assembly 230 and a second distal end pivotably or fixedly coupled to the first rail locking mechanism 224. In one example, the second top end rail member 218*b* can be fixedly coupled to the second corner assembly 230 and pivotably coupled to the first rail locking mechanism 224 and pivotable along the arc-path T about a fourth rotation axis at the pivotable coupling to the first rail locking mechanism 224. In certain example embodiments, the third rotation axis and the fourth rotation axis are parallel or substantially parallel to one another and the third rotation axis and the fourth rotation axis are orthogonal or substantially orthogonal to the first rotation axis and the second rotation axis.

A third support member 212 can have a first end pivotably coupled to the third corner assembly 232 and a distal second end. In one example, the second end of the third support member 212 can be configured to contact the ground or other flooring surface. The third support member 212 can pivot along the arc-path R about a fifth rotation axis at the pivotable coupling to the third corner assembly 232 from a use configuration (as shown in FIGS. 2A and 2C) to a stored configuration (as shown in FIG. 3A) and from the stored configuration back to the use configuration. In the stored configuration, the longitudinal axis of the third support member 212 is parallel or substantially parallel with the longitudinal axis of the second top side rail assembly 220. In certain example embodiments, the fifth rotation axis is parallel or substantially parallel to the first rotation axis and the second rotation axis and is orthogonal or substantially orthogonal to the third rotation axis and the fourth rotation axis. In one example, the fifth rotation axis is collinear with the second rotation axis.

In certain example embodiments, the second top side rail assembly 220 can have a first end pivotably or fixedly coupled to the fourth corner assembly 234 and a distal second end pivotably or fixedly coupled to the third corner assembly 232. In one example, the second top side rail assembly 220 does not pivot with respect to the fourth corner assembly 234 and the third corner assembly 232.

A fourth support member 214 can have a first end pivotably coupled to the fourth corner assembly 234 and a distal second end. In one example, the second end of the fourth support member 214 can be configured to contact the ground or other flooring surface. The fourth support member 214 can pivot along the arc-path S about a sixth rotation axis at the pivotable coupling to the fourth corner assembly 234 from a use configuration (as shown in FIGS. 2A and 2C) to a stored configuration (as shown in FIG. 3A) and from the stored configuration back to the use configuration. In the stored configuration, the longitudinal axis of the fourth support member 214 is parallel or substantially parallel with the longitudinal axis of the second top side rail assembly 220 and the third support member 212. In certain example embodiments, the sixth rotation axis is parallel or substantially parallel to the first rotation axis, the second rotation axis, and the fifth rotation axis and is orthogonal or substantially orthogonal to the third rotation axis and the fourth rotation axis. In one example, the sixth rotation axis is collinear with the first rotation axis.

In certain example embodiments, the second top end rail assembly 222 can have a third top end rail member 222*a* having a first end pivotably or fixedly coupled to the fourth corner assembly 234 and a second distal end pivotably or fixedly coupled to the second rail locking mechanism 226. In one example, the third top end rail member 222*a* can be fixedly coupled to the fourth corner assembly 234 and pivotably coupled to the second rail locking mechanism 226 and pivotable along the arc-path T about a seventh rotation axis at the pivotable coupling to the second rail locking mechanism 226.

The second top end rail assembly 222 can also have a fourth top end rail member 222*b* having a first end pivotably or fixedly coupled to the first corner assembly 228 and a distal second end pivotably or fixedly coupled to the second rail locking mechanism 226. In one example, the fourth top end rail member 218*b* can be fixedly coupled to the first corner assembly 228 and pivotably coupled to the second rail locking mechanism 226 and pivotable along the arc-path T about a eighth rotation axis at the pivotable coupling to the second rail locking mechanism 226. In certain example embodiments, the seventh rotation axis and the eighth rotation axis are parallel or substantially parallel to one another and to the third rotation axis and fourth rotation axis. Furthermore, in certain example embodiments, the seventh rotation axis and the eighth rotation axis are orthogonal or substantially orthogonal to the first rotation axis, second rotation axis, fifth rotation axis, and sixth rotation axis.

While the example embodiment above describes the first support member 208 and second support member 210 pivoting to be parallel or substantially parallel with the first top side rail assembly 216 and the third support member 212 and fourth support member 214 pivoting to be parallel or substantially parallel with the second top side rail assembly 220, this is for example purposes only. In other examples, the first support member 208 and fourth support member 214 can pivot to be parallel or substantially parallel with the second top end rail assembly 222 and the second support member 210 and the third support member 212 can pivot to be parallel or substantially parallel with the first top end rail assembly 218. In addition, the first top side rail assembly 216 could include two or more members and at least one rail locking mechanism and the second top side rail assembly 220 could include two or more members and at least one other rail locking mechanism similar to that described with reference to the first top end rail member 218*a*, first rail locking mechanism 224, and second top end rail member 218*b*.

In yet another example, each of the support members 208, 210, 212, 214 can be pivotable with respect to its respective corner assembly 228, 230, 232, 232 such that each support member, when rotated into a stored configuration would be parallel or substantially parallel with a different one of first top side rail assembly 216, first top end rail assembly 218, second top side rail assembly 220, second top end rail assembly 222. For example, first support member 208 can pivot at the pivotable coupling to the first corner assembly 228 from a use configuration to a stored configuration to be parallel or substantially parallel with the first top side rail assembly 216, the second support member 210 can pivot at the pivotable coupling to the second corner assembly 230 from a use configuration to a stored configuration to be parallel or substantially parallel with the first top end rail assembly 218, the third support member 212 can pivot at the pivotable coupling to the third corner assembly 232 from a use configuration to a stored configuration to be parallel or substantially parallel with the second top side rail assembly 220, and the fourth support member 214 can pivot at the pivotable coupling to the fourth corner assembly 234 from a use configuration to a stored configuration to be parallel or substantially parallel with the second top end rail assembly 222.

In certain example embodiments each of the support members 208, 210, 212, 214 can further include a foot assembly (not shown) coupled to the second end of the respective support member 208, 210, 212, 214. In one example, the foot assembly can be removably coupled to the respective support member 208, 210, 212, 214 and can be configured to contact the ground or floor surface. Each support member 208, 210, 212, 214 may be fixedly or removably coupled to the corresponding corner assembly 228, 230, 232, 234. Each of the first support member 208, second support member 210, third support member 212, and fourth support member 214 can be configured to provide vertical support to the top side rail assemblies 216, 220, top end rail assemblies 218, 222, and the corner assemblies 228, 230, 232, 234.

Each of the top side rail assemblies 216, 220 and top end rail assemblies 218, 222 are horizontally or substantially horizontally positioned when the playard 200 and/or frame 202 is in the use configuration, as shown in FIGS. 2A and 2C. In one example, the top side rail assemblies 216, 220, top end rail assemblies 218, 222, and the first 228, second 230, third 232, and fourth 234 corner assemblies collectively define a top end of the child containment area 240 for the playard. In certain example embodiments, each of the top side rail members of the top side rail assemblies 216, 220 and top end rail members 218*a*, 218*b*, 222*a*, 222*b* of the top end rail assemblies 218, 222 can have a circular, substantially circular, generally circular, or oval cross-sectional shape. In one example, the shape can increase the ease of slidably inserting and passing the top side rail members of the top side rail assemblies 216, 220 and/or top end rail members 218*a*, 218*b*, 222*a*, 222*b* of the top end rail assemblies 218, 222 through one or more top end channels along a top end of the fabric or other top rail soft goods material 237*a-d* in substantially the same manner as described with reference to FIGS. 1A-1I. In other example embodiments, each of the top side rail members of the top side rail assemblies 216, 220 and top end rail members 218*a*, 218*b*, 222*a*, 222*b* of the top end rail assemblies 218, 222 can have any other cross-sectional shape including, but not limited to, rectangular.

In certain example embodiments, each of the first support member 208, second support member 210, third support member 212, and fourth support member 214 pivots relative to its respective corner assembly 228, 230, 232, 234 and is spring-biased to pivot relative to its respective corner assembly 228, 230, 232, 234 into one of the use configuration (as shown in FIGS. 2A and 2C) and the stored configuration (as shown in FIG. 3A). In one example, each of the support members 208, 210, 212, 214 are spring-biased to move automatically to the stored configuration (as shown in FIG. 3A) absent a force being applied to the respective support member 208, 210, 212, 214 or a locking mechanism holding the support member 208, 210, 212, 214 in place in the use configuration.

The playard 200 can include one or more mechanisms or systems of mechanisms for spring-biasing each of the support members 208, 210, 212, 214. FIG. 2B presents a partial perspective and partial cut-away view of the frame assembly 202 showing one example of a spring-biasing system that can be incorporated into the frame assembly 202 of the playards 100, 200. Referring to FIG. 2B, while only one corner assembly and support member are shown, the concepts shown and described can be included in each of the corner assemblies 228, 230, 232, 234, support members 208, 210, 212, 214, and top side rail assemblies 216, 220 and/or top end rail assemblies 218, 222.

Each top side rail assembly 216, 220 can include one, two, or more channels 250 or passageways that extends along the longitudinal axis of the top side rail assembly 216, 220. In one example, the channel 250 can be an internal channel extending from a first opening along the first end to a second opening along the second end of the top side rail assembly 216, 220. In other examples, the channel 250 can be defined by one or more slots or elongated apertures along an exterior surface of the top side rail assembly.

The spring-biasing mechanism can include a position-biasing means 252 (e.g., gas spring, compression spring, extension spring, torsion spring, a rubber band, or another elastic member) that can be positioned within or adjacent to the channel 250. In one example, the position biasing means is a spring (e.g., gas spring, compression spring, extension spring, torsion spring, etc.). In one example, the spring can be a gas spring having a cylinder of compressed gas and a sliding piston. For example, a first end of the gas spring can be disposed along a first end of the channel 250 and can abut a seat within the channel 250 or a portion of the respective corner assembly 228, 230, 232, 234. The opposing second end of the gas spring and the sliding piston can extend within the channel 250 along the longitudinal axis of the respective top side rail assembly 216, 220. In another example the spring can be a compression spring that is positioned within the channel. For example, a first end of the spring 252 can be disposed along a first end of the channel 250 and can abut a seat or within the channel 250 or a portion of the respective corner assembly 228, 230, 232, 234. The opposing second end of the spring 252 can extend within the channel 250 along the longitudinal axis of the respective top side rail assembly 216, 220.

The spring-biasing mechanism can also include a wire or cable 254. The wire or cable 254 can have a first end and a distal second end. The first end of the wire or cable 254 can include or be coupled to a piston or catch member 256 having a width that is greater than the diameter of the spring 252, so as not to be pulled within the spring. The second end of the wire or cable 254 can be coupled to the respective support member 208, 210, 212, 214 for the particular corner assembly 228, 230, 232, 234. For example, second end of the wire or cable 254 can include an eyelet 258 and a fastener (e.g., a screw, pin, rivet, etc.) can extend through the eyelet 258 to couple the second end of the wire or cable 254 to the support member 208, 210, 212, 214. The wire or cable 254 can extend through the center of the spring 252 along its longitudinal axis between the piston or catch member 256 and the second end of the spring 252. In other examples, such as when a gas spring is used as the position-biasing means, the wire or cable 254 can extend alongside the gas spring or other position-biasing means along its longitudinal axis between the end of the piston on the gas spring and the second end of the gas spring.

The spring-biasing mechanism can also include a pulley 255. In one example, the pulley can be positioned adjacent to the first end of the spring 252 or other position-biasing means. The pulley 255 can be configured to provide a smooth adjustment of direction for the wire or cable 254 from extending along the longitudinal axis of the top side rail assembly 216, 220 to extending downward towards the particular support member 208, 210, 212, 214. The pulley 255 can be static (e.g., a smooth rounded corner) or configured to rotate along an axis that is orthogonal or substantially orthogonal to the longitudinal axis of the top side rail assembly 216. While the example embodiment of FIG. 2B presents the spring-biasing mechanism with position-biasing means 252 within the top side rail assembly 216, 220 and the wire 254 being coupled to an eyelet 258 on one of the support members 208, 210, 212, 214 this is for example purposes only as the elements can be reversed such that the position-biasing means can be disposed in a part (e.g., a channel or slot) of each of the support members 208, 210, 212, 214 and the wire 254 can extend to and be coupled to an eyelet 258 coupled to or within one of the top side rail assemblies 216, 220. In yet another alternative embodiment, a torsion spring can be used for position-biasing means 252 and it can be possible to position the torsion spring with or adjacent to the leg locking mechanism 262 discussed below and coupled to the support member 208, 210, 212, 214 and the respective corner assembly 228, 230, 232, 234 and/or another portion of the top frame assembly 204, and the wire or cable 254 and eyelet 258 may not be needed.

The corner assembly 228, 230, 232, 234 can include an aperture 260 that provides a passageway from the channel 250 of the top side rail assembly 216, 220 towards the particular support member 208, 210, 212, 214. As such, the wire or cable 254 can extend from the piston or catch member 256, through the spring 252 or other position-biasing means, around a portion of the pulley 255 and through the aperture 260 towards and be coupled to the particular support member 208, 210, 212, 214.

Each corner assembly 228, 230, 232, 234 can also include a leg locking mechanism 262. In one example, the leg locking mechanism 262 can include one or more tabs (for example on the corner assembly 228, 230, 232, 234) that engage one or more slots (for example on the support member 208, 210, 212, 214 or a lock extension coupled to the end of the support member 208, 210, 212, 214) to prevent rotation of the support member 208, 210, 212, 214 in relation to the respective corner assembly 228, 230, 232, 234. In certain examples, the tabs and slots can be reversed. Further, the tabs and slots can be arranged such that the leg locking mechanism will only lock in one position (e.g., when the support member 208, 210, 212, 214 has been moved into the use configuration). In certain examples, the tabs can be spring-biased to engage the slots such that as soon as the tabs and slots are aligned, the leg locking mechanism will lock the support member 208, 210, 212, 214 to prevent further rotation in the direction E or F.

The leg locking mechanism 262 can include a lock release mechanism 264. The lock release mechanism 264 can be any type of manually-adjustable device for unlocking one object from another, including, but not limited to, a push button (as shown in FIG. 2B), a lever, a squeeze handle, a switch, a rotating knob, an adjustable tab extending through a slot, a slide-lock, or the like). The lock release mechanism 264 can be operably coupled to the spring-biased tabs or other locking devices and configured to adjust the spring-biased tabs or other locking device in a direction to disengage the tabs from the slots or to otherwise unlock the leg locking mechanism. In the example of FIGS. 2A-2C, the lock release mechanism 264 can be manually adjustable by a user in the direction Z by the application of a manual force by the user's hand or other body part to move the lock release mechanism 264 from a first, locked, position to a second, leg release, position. The leg locking mechanism 262 can also include a spring or other biasing device to spring-bias the lock release mechanism 264 in the direction opposite Z.

Returning to FIGS. 2A and 2C, top rail soft goods 237*a-d*, which can be similar or substantially the same as the top rail soft goods 124 of FIG. 1A, and can include, for example, any combination of fabric material, plastic material, padding, see-through mesh material, or any other material known to those of ordinary skill in the art, can be fixedly or removably coupled to the top frame assembly 204. For example, the top rail soft goods 237*a-d* can be stitched or otherwise affixed to itself such that the top rail soft goods overlap and are vertically supported by the top frame assembly 204. For example, the top rail soft goods, including padding, can include a first top rail soft goods section 237*a* that overlaps the first top side rail assembly 216 and first corner assembly 228, a second top rail soft goods section 237*b* that overlaps the first top end rail assembly 218 and second corner assembly 230, a third top rail soft goods section 237*c* that overlaps the second top side rail assembly 220 and third corner assembly 232, and a fourth top rail soft goods section 237*d* that overlaps the second top end rail assembly 222 and fourth corner assembly 234.

While the top rail soft goods 237*a-d* are described herein as being top rail soft goods sections, this is only for ease of description of the position of each section 237*a*, 237*b*, 237*c*, 237*d* of the top rail soft goods 237*a-d*. The use of the term section with regard to the top rail soft goods 237*a-d* is not intended to imply that each section is separate from each other section. While it is possible that each section is separate from each other section, in other example embodiments, each section 237*a*, 237*b*, 237*c*, 237*d* can be integrally formed with each other section to create a single top rail soft goods, or one or more sections may be divided along a portion of the section to split the particular section into two or more subsections of the particular section.

In certain example embodiments, the overlapping top rail soft goods 237*a-d* can define one or more first channels or passageways through which the rail members of the first top side rail assembly 216, first top end rail assembly 218, second top side rail assembly 220, and second top end rail assembly 222 can be inserted and/or extend through. In addition, the top rail soft goods 237*a-d* or particular sections of the top rail soft goods 237*a-d* may be stitched or otherwise affixed to the soft goods (e.g., a fabric mesh) that form each side wall/panel 225, 227, 229, 231. As such, the top frame assembly 204, can provide vertical support for each of the side walls/panels 225, 227, 229, 231 via the top rail soft goods 237*a-d*.

Referring now to FIGS. 2A-3B, when the support members 208, 210, 212, 214 are in the stored configuration (as shown in FIG. 3A), being parallel or substantially parallel with the longitudinal axis of the top side rail assembly 216, 220, a user can manually pivot the support member 208, 210, 212, 214 with respect to the corner assembly 228, 230, 232, 234 in the direction E, until the support member 208, 210, 212, 214 extends generally downward from the particular corners assembly 228, 230, 232, 234. As the support member 208, 210, 212, 214 is pivoting in the direction E, the support member 208, 210, 212, 214 creates a tension force on the wire or cable 254, which is of a fixed length, and causes the piston or catch member 256 to be pulled in the direction C due to the tension force on the wire or cable 254. The piston or catch member 256, moving in the direction C, compresses the spring 252 or other position-biasing device in the direction C. The support member 208, 210, 212, 214 can continue to be rotated in the direction E until the leg locking mechanism 262 engages or locks (e.g., the tabs of the leg locking mechanism engage the slots) the support member 208, 210, 212, 214 and prevents further rotation in the direction E or F. This manual force can be applied to each of the support members 208, 210, 212, 214 to move each from the stored configuration (as shown in FIG. 3A) to the use configuration (as shown in FIGS. 2A and 2C). In certain examples, manual force can be applied to two or more support members 208, 210, 212, 214 at the same time to adjust the two or more support members 208, 210, 212, 214 from the stored configuration to the use configuration simultaneously or substantially simultaneously.

In the use configuration, the spring 252 or other position-biasing means is under a compression force. When a user wishes to adjust the playard 200 from the use configuration to the folded configuration, the user can apply a manual force to the lock release mechanism 264 to adjust the leg locking mechanism 262 from the locked position to the leg release position. For example, the user can move the lock release mechanism 264 in the direction Z to adjust the leg locking mechanism 262 from the locked position to the leg release position. Once the leg locking mechanism 262 is in the leg release position, the compression force built up/stored in the spring 252 or other position-biasing means moves the piston or catch member 256 the direction D. Movement of the piston or catch member 256 in the direction D also pulls the wire or cable 252 nearest the piston or catch member 256 in the direction D about the pulley 255, causing the wire to transfer the force from the spring 252 to the support member 208, 210, 212, 214 to pivot automatically in the direction F until the support member 208, 210, 212, 214 is parallel or substantially parallel with the respective top side rail assembly 216, 220. Each of the support members 208, 210, 212, 214 may be similarly adjusted at their respective corner assemblies 228, 230, 232, 234 to place the support members 208, 210, 212, 214 in the stored configuration as shown in FIG. 3A. In certain examples, manual force can be applied to two or more lock release mechanisms 264 at the same time to adjust the two or more support members 208, 210, 212, 214 from the use configuration to the stored configuration simultaneously or substantially simultaneously. This adjustment of each of the support members 208, 210, 212, 214 can occur with or without the soft goods (e.g., the side walls/panels 225, 229; end walls panels 227, 231; the base or bottom panel 233; and/or the top rail soft goods 237*a-d*) attached to the frame assembly 202.

Figure 3B:
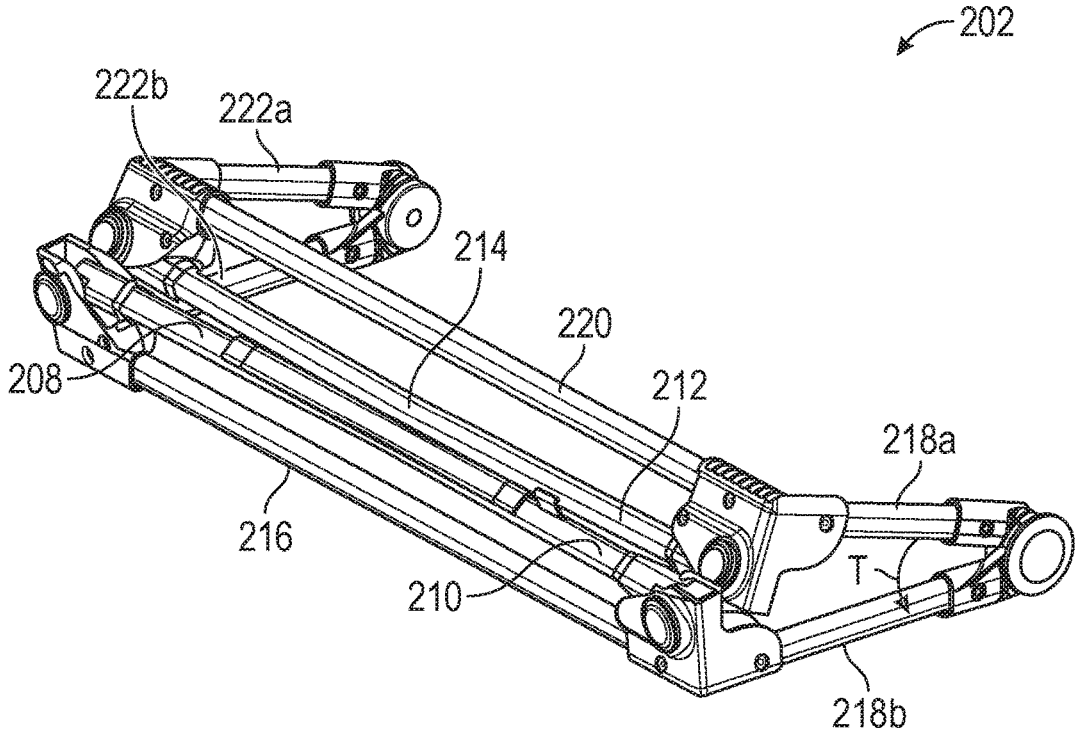
FIG. 3B is a perspective view of the frame assembly of FIG. 2A in a fully folded configuration, in accordance with one example embodiment of the disclosure.

The playard 200 of FIGS. 2A-3B may be further folded by folding the first top end rail member 218*a* towards the second top end rail member 218*b* along the arc path T and the third top end rail member 222*a* towards the fourth top end rail member 222*b* along the arc path U to position the first support member 208 and second support member 210 adjacent and optionally abutting the third support member 212 and fourth support member 214, as shown in FIG. 3B.

Though the disclosed example includes a particular arrangement of a number of parts, components, features, and aspects, the disclosure is not limited to only that example or arrangement. Any one or more of the parts, components, features, and aspects of the disclosure can be employed alone or in other arrangements of any two or more of the same.

Although certain playard and bassinet features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A playard comprising: a playard frame comprising:

a top frame assembly; and a plurality of support members operably coupled to the top frame assembly and extending down from the top frame assembly;

a top rail soft goods disposed about at least a portion of the top frame assembly;

a plurality of soft goods panels comprising at least one side wall panel and a floor panel; a first partial bassinet base permanently coupled to a first portion of the top rail soft goods; and a second partial bassinet base permanently coupled to a second portion of the top rail soft goods and removably coupled to the first partial bassinet base, wherein the first portion of the top rail soft goods further comprises a first top end removably coupled to a first bottom end and defining an entry to a first interior cavity in the first portion of the top rail soft goods, wherein the first partial bassinet base is configured to be stored in the first interior cavity.

2. The playard of claim 1, wherein the first partial bassinet base comprises four sides, wherein a first side, a second side, and a third side of the first partial bassinet base are permanently coupled to the first portion of the top rail soft goods and wherein a fourth side comprises a first zipper chain.

3. The playard of claim 2, wherein the second partial bassinet base comprises four sides, wherein a first side, a second side, and a third side of the second partial bassinet base are permanently coupled to the second portion of the top rail soft goods and wherein a fourth side of the second partial bassinet base comprises a second zipper chain; and wherein the playard further comprises a first zipper slider movably coupled to at least one of the first zipper chain and the second zipper chain, wherein the first zipper chain is removably coupled to the second zipper chain.

4. The playard of claim 2, wherein the at least four side wall panels and the floor panel define a child containment area, wherein the first partial bassinet base extends across only a portion of the child containment area.

5. The playard of claim 1, wherein the top rail soft goods comprise a second interior cavity separate from the first interior cavity, wherein at least a portion of the top frame assembly extends through the second interior cavity.

6. The playard of claim 1, wherein the first top end comprises a first zipper chain and the first bottom end comprises a second zipper chain, wherein a first zipper slider is movably coupled to at least one of the first zipper chain and the second zipper chain and configured to couple and decouple the first top end to the first bottom end.

7. The playard of claim 1, wherein the second portion of the top rail soft goods further comprises a second top end removably coupled to a second bottom end and defining a second entry to a second interior cavity in the second portion of the top rail soft goods, wherein the second partial bassinet base is configured to be stored in the second interior cavity.

8. The playard of claim 7, wherein the second top end comprises a third zipper chain and the second bottom end comprises a fourth zipper chain, wherein a second zipper slider is movably coupled to at least one of the third zipper chain and the fourth zipper chain and configured to couple and decouple the second top end to the second bottom end.

9. A playard comprising:

a playard frame comprising:

a top frame assembly comprising:

a plurality of top rail members; and a plurality of spring-biasing mechanisms; and a plurality of support members, each of the plurality of support members operably coupled to one of the plurality of spring-biasing mechanisms and extending down from the top frame assembly, wherein each of the plurality of support members pivots with respect to the top frame assembly from a use configuration to a stored configuration and wherein each of the plurality of support members is spring-biased into one of the use configuration or the stored configuration by one of the plurality of spring-biasing mechanisms; and a plurality of soft goods panels comprising:

at least one side wall panel coupled to the top frame assembly or at least one of the plurality of support members;

a floor panel; and a top rail soft goods panel with a first top end removably coupled to a first bottom end and defining an entry to a first interior cavity in the first portion of the top rail soft goods panel, wherein a first partial bassinet base is configured to be stored in the first interior cavity.

10. The playard of claim 9, wherein each of the plurality of support members is spring biased into the stored configuration.

11. The playard of claim 9, wherein each of the plurality of spring-biasing mechanisms comprises:

a spring;

a catch member disposed along a first end of the spring;

a wire comprising a first end coupled to the catch member and a second end coupled to one of the plurality of support members.

12. The playard of claim 11, wherein each of the plurality of spring-biasing mechanisms further comprises:

a leg locking mechanism operably coupled to a first end of the one of the plurality of support members; and a lock release mechanism operably coupled to the leg locking mechanism.

13. The playard of claim 11, wherein the spring is disposed within a channel of one of the plurality of top rail members and extends along a longitudinal axis of the channel.

14. The playard of claim 9, wherein the plurality of top frame members comprises: a first top side rail assembly comprising a first longitudinal axis;

a first top end rail assembly;

a second top side rail assembly comprising a second longitudinal axis; and a second top end rail assembly.

15. The playard of claim 14, wherein the first top end rail assembly comprises:

a first top end rail member; and a second top end rail member pivotably coupled to the first top end rail member; wherein the second top end rail assembly comprises:

a third top end rail member; and a fourth top end rail member pivotably coupled to the third top end rail member.

16. The playard of claim 14, wherein the playard further comprises:

a first corner assembly coupled to a first end of the first top side rail assembly and a second end of the second top end rail assembly;

a second corner assembly coupled to a second end of the first top side rail assembly and a second end of the first top end rail assembly;

a third corner assembly coupled to a second end of the second top side rail assembly and a first end of the first top end rail assembly; and a fourth corner assembly coupled to a first end of the second top side rail assembly and a first end of the second top end rail assembly.

17. A playard comprising: a playard frame comprising:

a top frame assembly defining a four-sided top frame; a plurality of spring-biasing mechanisms; and a plurality of leg members, each of the plurality of leg members operably coupled to one of the plurality of spring-biasing mechanisms and extending down from the top frame assembly, wherein each of the plurality of leg members pivots with respect to the top frame assembly from a use configuration to a stored configuration and wherein each of the plurality of leg members is spring-biased into the stored configuration by one of the plurality of spring-biasing mechanisms;

a top rail soft goods disposed about at least a portion of the top frame assembly;

a plurality of soft goods panels comprising at least four side wall panels and a floor panel; a bassinet base comprising:

a first partial bassinet base permanently coupled to a first portion of the top rail soft goods and configured to be stored within a first cavity of the first portion of the top rail soft goods; and a second partial bassinet base permanently coupled to a second portion of the top rail soft goods and configured to be stored within a second cavity of the second portion of the top rail soft goods, wherein the second partial bassinet base is removably coupled to the first partial bassinet base wherein the first portion of the top rail soft goods further comprises a first top end removably coupled to a first bottom end and defining an entry to a first interior cavity in the first portion of the top rail soft goods, wherein the first partial bassinet base is configured to be stored in the first interior cavity.

18. The playard of claim 17, wherein each of the plurality of spring-biasing mechanisms comprises:

a spring;

a catch member disposed along a first end of the spring;

a wire comprising a first end coupled to the catch member and a second end coupled to one of the plurality of leg members;

a leg locking mechanism operably coupled to a first end of the one of the plurality of leg members and adjustable from a leg release position to a locked position to lock the one of the plurality of leg members in the use configuration; and a lock release mechanism operably coupled to the leg locking mechanism and configured to release the leg locking mechanism from the locked position.

19. The playard of claim 17, wherein the first partial bassinet base comprises four sides, wherein a first side, a second side, and a third side of the first partial bassinet base are permanently coupled to the first portion of the top rail soft goods and wherein a fourth side comprises a first zipper chain, wherein the second partial bassinet base comprises four sides, wherein a first side, a second side, and a third side of the second partial bassinet base are permanently coupled to the second portion of the top rail soft goods and wherein a fourth side of the second partial bassinet base comprises a second zipper chain; and wherein the playard further comprises a first zipper slider movably coupled to at least one of the first zipper chain and the second zipper chain, wherein the first zipper chain is removably coupled to the second zipper chain.

* * * * *